US008864463B2

(12) United States Patent
Conley et al.

(10) Patent No.: US 8,864,463 B2
(45) Date of Patent: Oct. 21, 2014

(54) FAN WITH POWER DEPLOYED FAN BLADE

(75) Inventors: William Conley, Long Beach, CA (US); Rodger Thomason, Santa Monica, CA (US); Ricardo Lopez, Fontana, CA (US)

(73) Assignee: Swiss Module Group LLC, Santa Monica, CA (US)

( * ) Notice: Subject to any disclaimer, the term of this patent is extended or adjusted under 35 U.S.C. 154(b) by 588 days.

(21) Appl. No.: 13/250,792

(22) Filed: Sep. 30, 2011

(65) Prior Publication Data

US 2013/0084180 A1 Apr. 4, 2013

(51) Int. Cl.

| | |
|---|---|
| ***F01D 5/00*** | (2006.01) |
| ***B64C 11/28*** | (2006.01) |
| ***F04D 29/36*** | (2006.01) |

(52) U.S. Cl.

CPC ..... *F04D 29/364* (2013.01)
USPC ..... 416/1; 416/170 R; 416/143; 416/160; 416/168 R

(58) Field of Classification Search

USPC ..... 416/142, 143, 160; 415/124.1
See application file for complete search history.

(56) References Cited

U.S. PATENT DOCUMENTS

| | | | |
|---|---|---|---|
| 1,361,785 | A | 12/1920 | Tucker |
| 1,445,402 | A | 2/1923 | Le Velle |
| 1,458,348 | A | 6/1923 | Le Velle |
| 2,079,942 | A | 5/1937 | Le Velle |
| 3,692,427 | A | 9/1972 | Risse |
| 4,640,668 | A | 2/1987 | Yang |
| 4,884,947 | A | 12/1989 | Rezek |
| 6,592,328 | B1 | 7/2003 | Cahill |
| 6,932,578 | B2 | 8/2005 | Pearce |
| 7,153,100 | B2 * | 12/2006 | Frampton et al. ..... 416/5 |
| 2008/0226449 | A1 * | 9/2008 | Villella ..... 416/87 |
| 2008/0286103 | A1 * | 11/2008 | Gajewski et al. ..... 416/87 |

FOREIGN PATENT DOCUMENTS

| | | | |
|---|---|---|---|
| JP | 59167985 | U | 11/1984 |
| JP | 59197747 | A | 11/1984 |
| JP | 62180693 | U | 11/1987 |
| JP | 08121379 | A | 5/1996 |

OTHER PUBLICATIONS

U.S. Appl. No. 12/123,392, filed May 19, 2008, Gajewski, Mark.
U.S. Appl. No. 12/123,398, filed May 19, 2008, Gajewski, Mark.
International Searching Authority, International Search Report and Written Opinion of the International Searching Authority for PCTUS2008064023 mailed Nov. 21, 2008 (3934.003pct).
International Searching Authority, International Search Report and Written Opinion of the International Searching Authority for PCTUS2008064024 mailed Sep. 25, 2008 (3934.004PC).

* cited by examiner

*Primary Examiner* — Edward Look
*Assistant Examiner* — Michael Sehn
(74) *Attorney, Agent, or Firm* — Cislo & Thomas, LLP

(57) ABSTRACT

A rotating fan with a transmission mechanism and a blade deployment mechanism. In an energized state, an electromagnetic coil generates a magnetic force that causes a clutch plate to be in contact with a contact surface, thereby engaging a planetary gear system. In a de-energized state, the clutch plate is not in contact with the contact surface, thereby disengaging the planetary gear system. In a deployed configuration, a drive link activated by the planetary gear system rotates a blade link to cause a fan blade to pivot. The result is that the fan blade tip is farther from the motor shaft than the fan blade root. In a retracted configuration, the drive link rotates the blade link to cause the fan blade to pivot and retract. The result is that the fan blade tip is equidistant from the motor shaft as the fan blade root.

20 Claims, 14 Drawing Sheets

FAN WITH POWER DEPLOYED FAN BLADE

TECHNICAL FIELD

This invention relates to axial-flow, rotating fans, particularly ceiling fans.

BACKGROUND ART

Electric ceiling fans are commonly utilized to assist heating and air conditioning systems or to provide air circulation within a room. Many modern ceiling fans consist of an electric motor suspended from a ceiling on a shaft, with a number of fan blades rotated by the motor.

It is also desirable to have an electric ceiling fan where the fan blades can be retracted during periods of non-use and then extended during conventional use. The state of the art includes several methods for accomplishing this, including the device taught by U.S. Pat. No. 7,857,591. However, the existing designs utilize multiple motors one for rotating the fan blades during conventional use and one to deploy and retract each fan blade. This can make the fan design overly complicated and heavy.

Accordingly, there is a need for a fan having retractable and deployable fan blades, where the same motor is used to deploy and retract the fan blades and to rotate the fan blades during conventional use.

DISCLOSURE OF INVENTION

In one aspect of the invention, the disclosed device is an axial-flow, rotating fan that has a stationary motor shaft, an electric fan motor mounted to and rotating about the motor shaft, a motor hub connected to the fan motor and rotating about the motor shaft with the fan motor, a transmission mechanism connected to the motor hub, a first fan blade, and a blade deployment mechanism.

The motor hub has an engagement surface, which is preferably a series of internal splines. The transmission mechanism includes a sun gear, a ring gear housing, a clutch plate, a contact surface, an electromagnetic coil, a sun gear spring, a first planet gear, a second planet gear, and a planet gear carrier.

The sun gear has an engagement portion, a first geared portion, and a second geared portion. The engagement portion is shaped and dimensioned to engage the engagement surface of the motor hub. The first geared portion of the sun gear has a series of gear teeth arranged radially about the motor shaft. The second gear portion also has a series of gear teeth arranged radially about the motor shaft.

The ring gear housing has a first internal spline to engage the second geared portion of the sun gear. The clutch plate is connected to the ring gear housing by a clutch plate spring. The clutch plate spring provides spring resistance to the clutch plate moving away from the ring gear housing. The contact surface is fixed to the motor shaft and is adjacent to the clutch plate. The sun gear spring provides a spring force to engage the engagement portion of the sun gear with the engagement surface of the motor hub.

The first planet gear is rotatively connected to the ring gear housing about a first planet gear axle, and the first planet gear engages a second internal spline of the ring gear housing. The second internal spline of the ring gear housing is radially farther from the motor shaft than the first geared portion of the sun gear. The first planet gear rotates about the first planet gear axle and also revolves about the sun gear. The second planet gear is rotatively connected to the ring gear housing about a second planet gear axle. The second planet gear also engages the second internal spline of the ring gear housing. The second planet gear rotates about the second planet gear axle and also revolves about the sun gear. The planet gear carrier rigidly connects the first planet gear axle and the second planet gear axle.

The first fan blade has a first fan blade tip and a first fan blade root. The blade deployment mechanism includes a main fan plate, a first drive link, a first blade link, and a first blade pivot assembly.

The main fan plate is connected to the ring gear housing. The first drive link has a first, curved end and an opposite second end. The first end of the first drive link is connected to the planet gear carrier. The first blade link is pivotally connected to the second end of the first drive link at an end of the first blade link.

The first blade pivot assembly is mounted to the main fan plate, and the first blade pivot assembly is connected to an opposite end of the first blade link. The first blade pivot assembly pivotally connects the first fan blade to the main fan plate at the first fan blade root.

The blade deployment mechanism may also include a first idler arm. The first idler arm is connected to the first drive link, and the first idler arm is between the first end and the second end of the first drive link. The first idler arm pivotally connects the first drive link to the main fan plate.

Preferably, the fan also includes a second fan blade, a second drive link, a second link, and a second blade pivot assembly. The second fan blade has a second fan blade tip and a second fan blade root. The second drive link has a first, curved end and an opposite second end. The first end of the second drive link is connected to the planet gear carrier. The second blade link is pivotally connected to the second end of the second drive link at an end of the second blade link. The second blade pivot assembly is mounted to the main fan plate. The second blade pivot assembly is connected to an opposite end of the second blade link. The second blade pivot assembly pivotally connects the second fan blade to the main fan plate at the second fan blade root. This version of the invention may also include a second idler arm. The second idler arm is connected to the second drive link. The second idler arm is between the first end and the second end of the second drive link. The second idler arm pivotally connects the second drive link to the main fan plate.

The engagement portion of the sun gear slides within the motor hub while continuously engaging the engagement surface of the motor hub. The second geared portion of the sun gear slides within the ring gear housing to engage and disengage the first internal spline of the ring gear housing.

In an energized state, the electromagnetic coil is energized and generates a magnetic force. The clutch plate is in contact with the contact surface due to the magnetic force of the electromagnetic coil, and the sun gear is disengaged from the first internal spline of the ring gear housing due to the magnetic force of the electromagnetic coil.

In a de-energized state, the electromagnetic coil is de-energized and does not generate the magnetic force. The clutch plate is not in contact with the contact surface due to the spring resistance of the clutch plate spring, and the sun gear is engaged with the first internal spline of the ring gear housing due to the spring force of the sun gear spring.

In a deployed configuration, the first end of the first drive link rotates about the motor shaft in a first rotative direction and activates the first blade link to rotate in the first rotative direction about the first blade pivot assembly. The first blade link causes the first fan blade to pivot about the first blade pivot assembly in the first rotative direction. The result is that the first fan blade tip is farther from the motor shaft than the first fan blade root. Likewise, the first end of the second drive link rotates about the motor shaft in the first rotative direction and activates the second blade link to rotate in the first rotative direction about the second blade pivot assembly. The second blade link causes the second fan blade to pivot about the second blade pivot assembly in the first rotative direction. The result is that the second an blade tip is farther from the motor shaft than the second fan blade root.

In a retracted configuration, the first end of the first drive link rotates about the motor shaft in a second rotative direction and activates the first blade link to rotate in the second rotative direction about the first blade pivot assembly. The first blade link causes the first fan blade to pivot about the first blade pivot assembly in the second rotative direction. The result is that the first fan blade tip is equidistant from the motor shaft as the first fan blade root. Likewise, the first end of the second drive link rotates about the motor shaft in the second rotative direction and activates the second blade link to rotate in the second rotative direction about the second blade pivot assembly. The second blade link causes the second first blade to pivot about the second blade pivot assembly in the second rotative direction. The result is that the second fan blade tip is equidistant from the motor shaft as the second fan blade root.

In another aspect of the invention, a method of deploying and retracting the fan blades of a fan includes the steps of providing a fan with the inventive features discussed here. The method also includes the steps of: (a) energizing the electromagnetic coil to produce a magnetic force; (b) the magnetic force pulling the clutch plate in contact with the contact surface, thereby locking the ring gear housing to the motor shaft via the coil housing; (c) the magnetic force also pulling the sun gear toward the electromagnetic coil, thus disengaging the sun gear from the first internal spline of the ring gear housing; (d) operating the electric fan motor in a first rotative direction; (e) the electric fan motor thereby turning the motor hub and the sun gear about the motor shaft in the first rotative direction, the sun gear engaging the first planet gear and the second planet gear causing the first planet gear and the second planet gear to revolve around the sun gear in a second rotative direction opposite to the first rotative direction, which causes the planet gear carrier to rotate about the motor shaft in the first rotative direction; (f) the rotating planet gear carrier thereby activating the first drive link and the second drive link, the first end of the first drive link rotating about the motor shaft in the first rotative direction and activating the first blade link to rotate in the first rotative direction about the first blade pivot assembly, thereby pivoting the first fan blade about the first blade pivot assembly in the first rotative direction and into a deployed configuration where the first fan blade tip is farther from the motor shaft than the first fan blade root, the first end of the second drive link rotating about the motor shaft in the first rotative direction and activating the second blade link to rotate in the first rotative direction about the second blade pivot assembly, thereby pivoting the second fan blade about the second blade pivot assembly in the first rotative direction and into the deployed configuration where the second fan blade tip is farther from the motor shaft than the second fan blade root; (g) de-energizing the electromagnetic coil; (h) the plurality of clutch plate springs pushing the clutch plate toward the ring gear housing and out of contact with the contact surface, thereby disconnecting the ring gear housing from the motor shaft and the coil housing; (i) the sun gear spring pushing the sun gear away from the electromagnetic coil and toward the electric fan motor to engage the sun gear with the first internal spline of the ring gear housing; (j) operating the electric thin motor to revolve the first fan blade and the second fan blade about the motor shaft for a desired period of time; (k) stopping the electric fan motor; (l) energizing the electromagnetic coil to produce the magnetic force; (m) the magnetic force pulling the clutch plate in contact with the contact surface, thereby locking the ring gear housing to the motor shaft via the coil housing; (n) the magnetic force pulling the sun gear toward the electromagnetic coil, thus disengaging the sun gear from the first internal spline of the ring gear housing; (o) operating the electric fan motor in the second rotative direction; (p) the electric fan motor thereby turning the sun gear about the motor shaft in the second rotative direction, the sun gear engaging the first planet gear and the second planet gear, causing the first planet gear and the second planet gear to revolve around the sun gear in the first rotative direction, which causes the planet gear carrier to rotate about the motor shaft in the second rotative direction; and (q) the rotating planet gear carrier thereby activating the first drive link and the second drive link, the first end of the first drive link rotating about the motor shaft in the second rotative direction and activating the first blade link to rotate in the second rotative direction about the first blade pivot assembly, thereby pivoting the first fan blade about the first blade pivot assembly in the second rotative direction and into a retracted configuration where the first fan blade tip is equidistant from the motor shaft as the first fan blade root, and the first end of the second drive link rotating about the motor shaft in the second rotative direction and activating the second blade link to rotate in the second rotative direction about the second blade pivot assembly, thereby pivoting the second fan blade about the second blade pivot assembly in the second rotative direction and into the retracted configuration where the second fan blade tip is equidistant from the motor shaft as the second fan blade root.

BEST MODE FOR CARRYING OUT THE INVENTION

Figure 1:
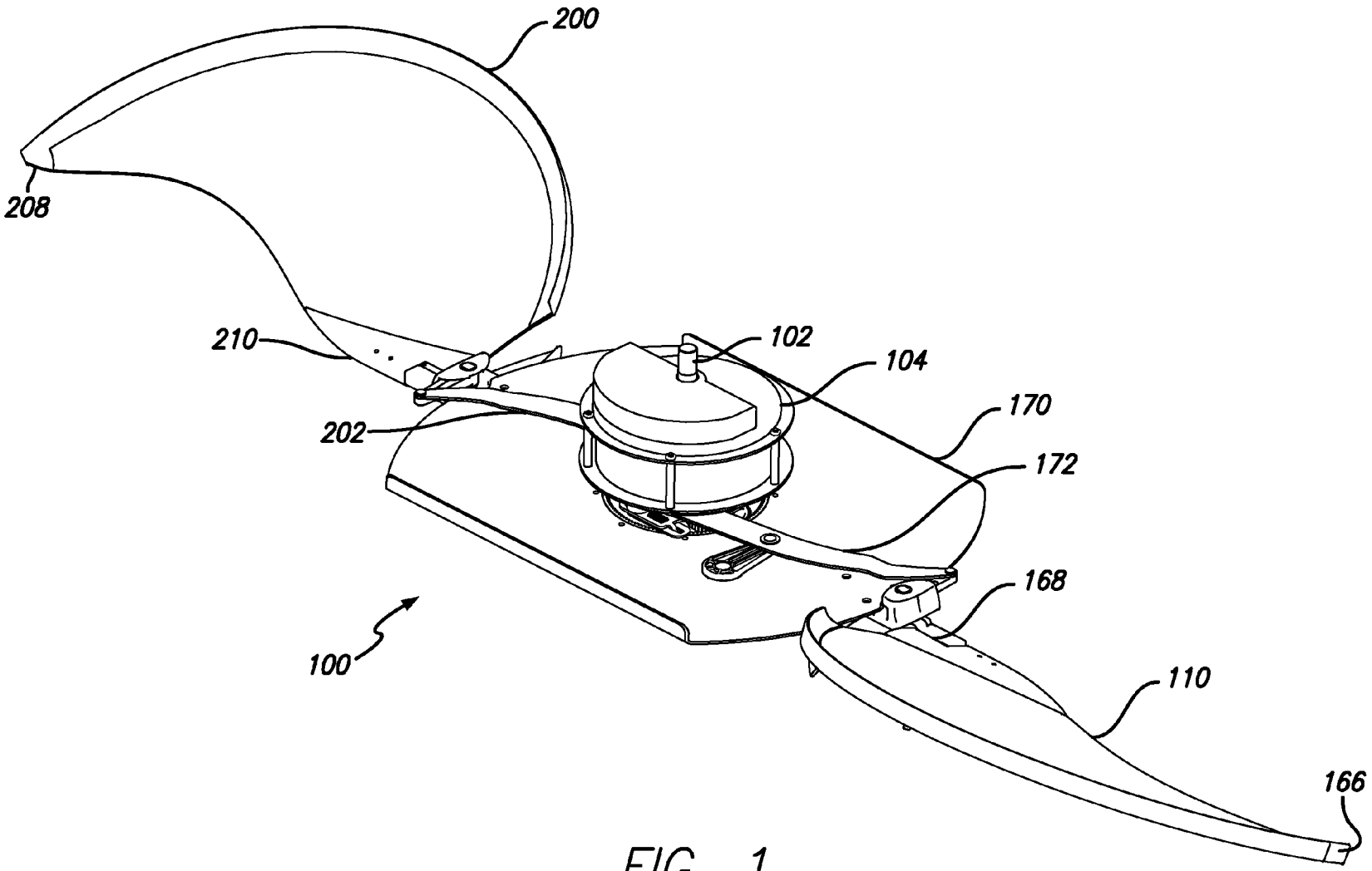
FIG. 1 is a perspective view of an embodiment of a Fan with Power Deployed Fan Blade in the deployed configuration.
Figure 2:
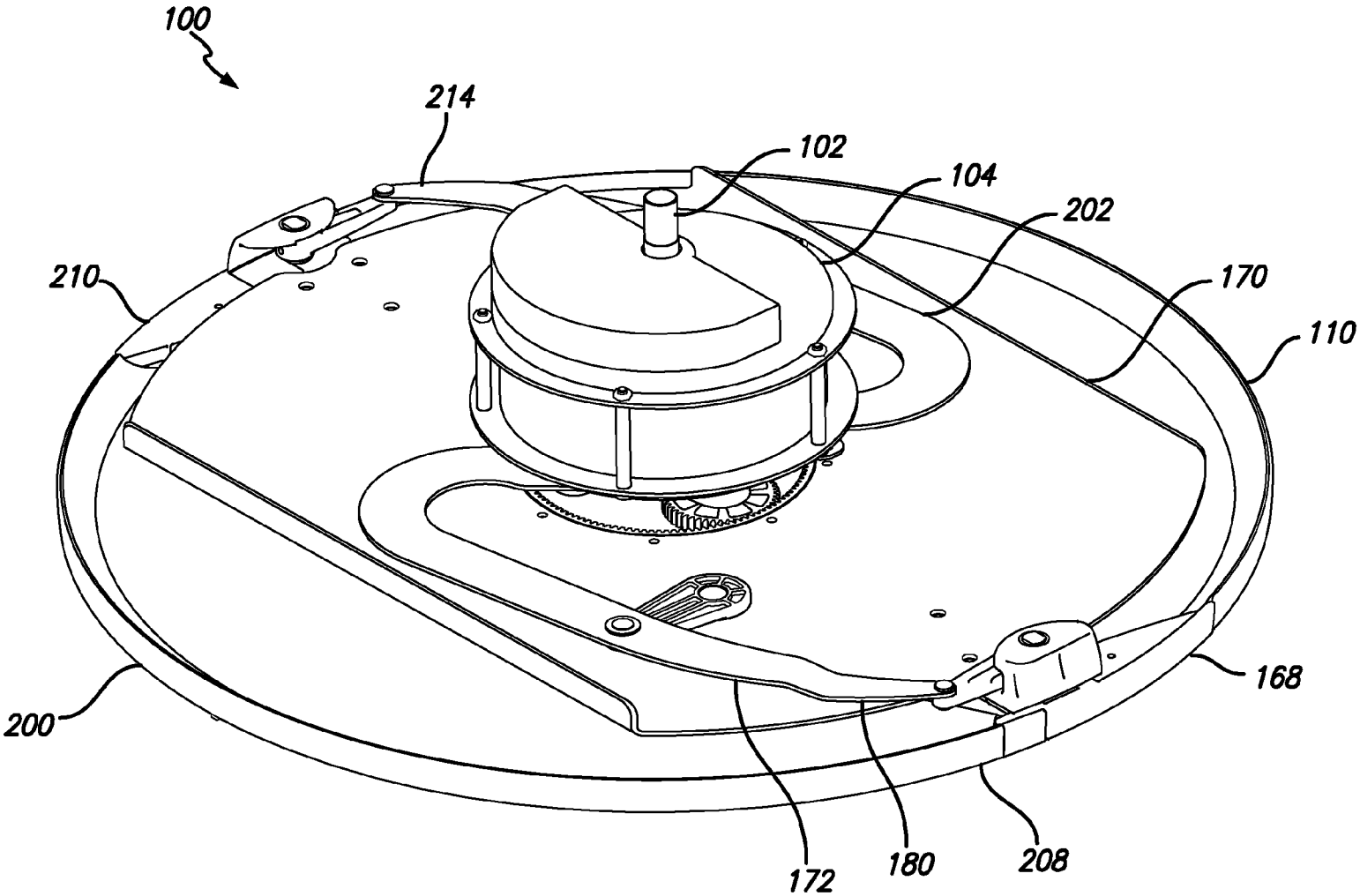
FIG. 2 is a perspective view of an embodiment of a Fan with Power Deployed Fan Blade in the retracted configuration.
Figure 3:
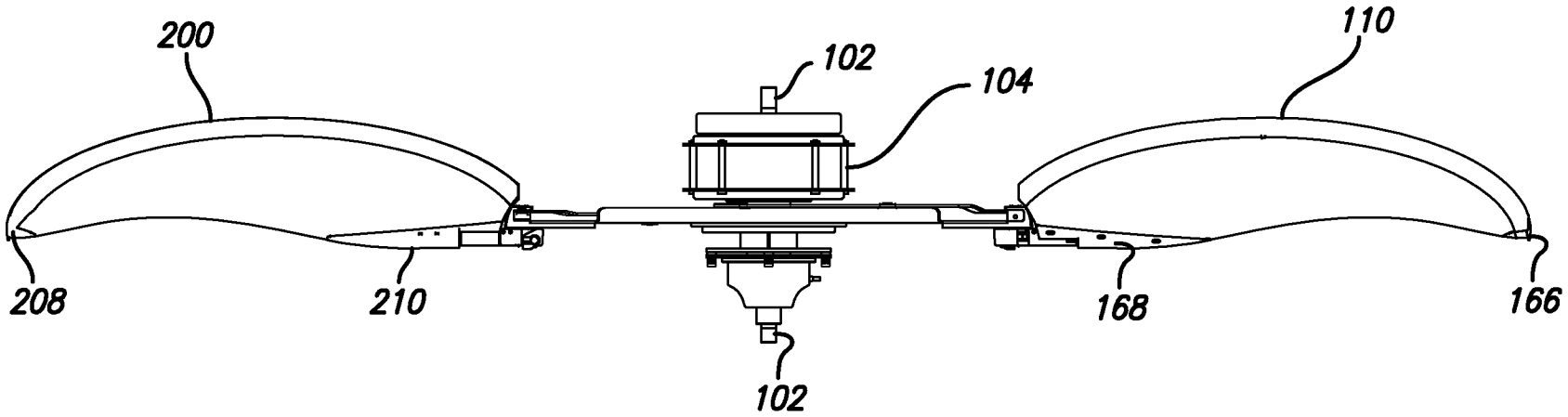
FIG. 3 is a front view of the fan shown in FIG. 1.
Figure 4:
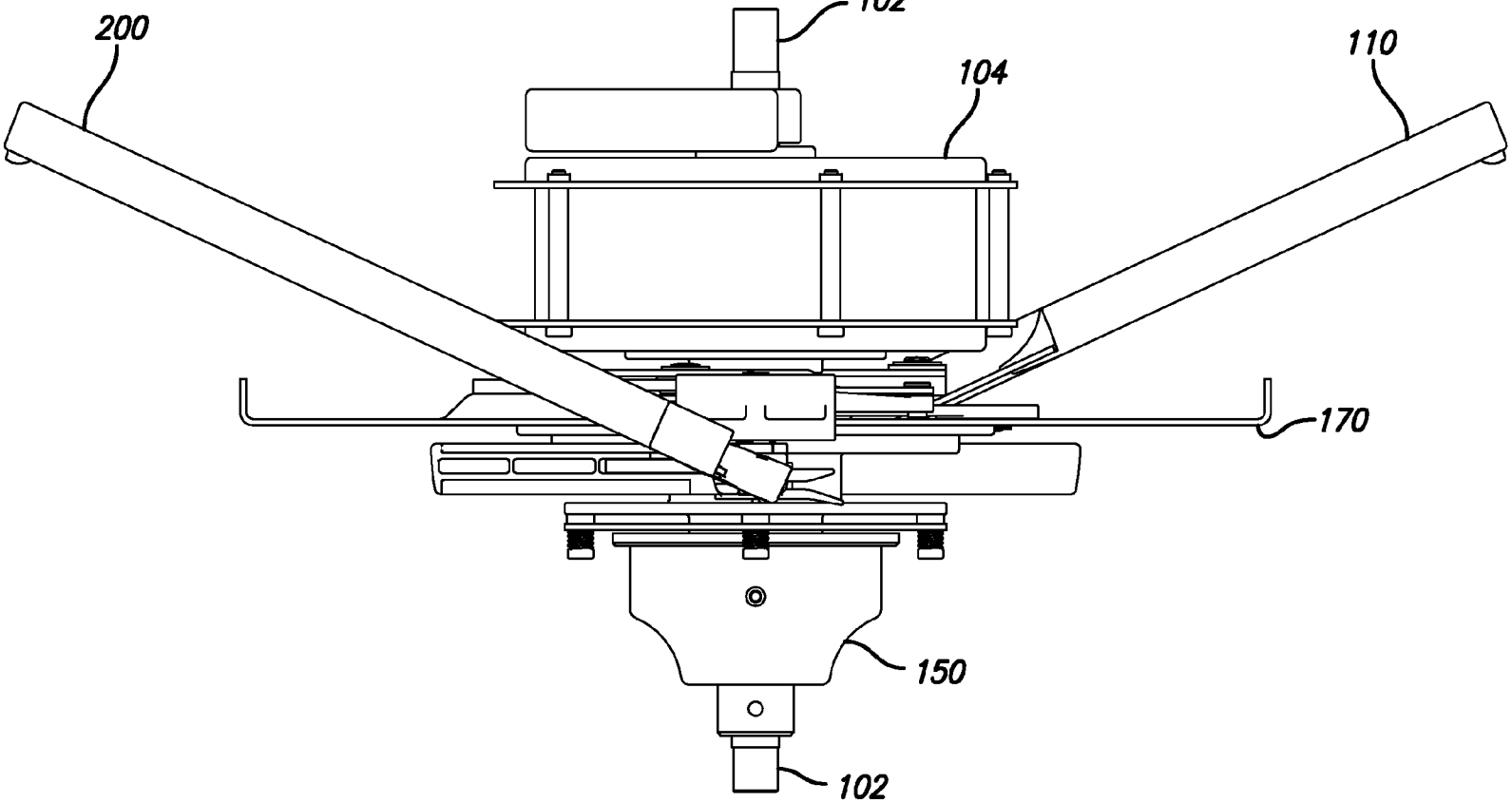
FIG. 4 is a right side view of the thin shown in FIG. 1.
Figure 5:
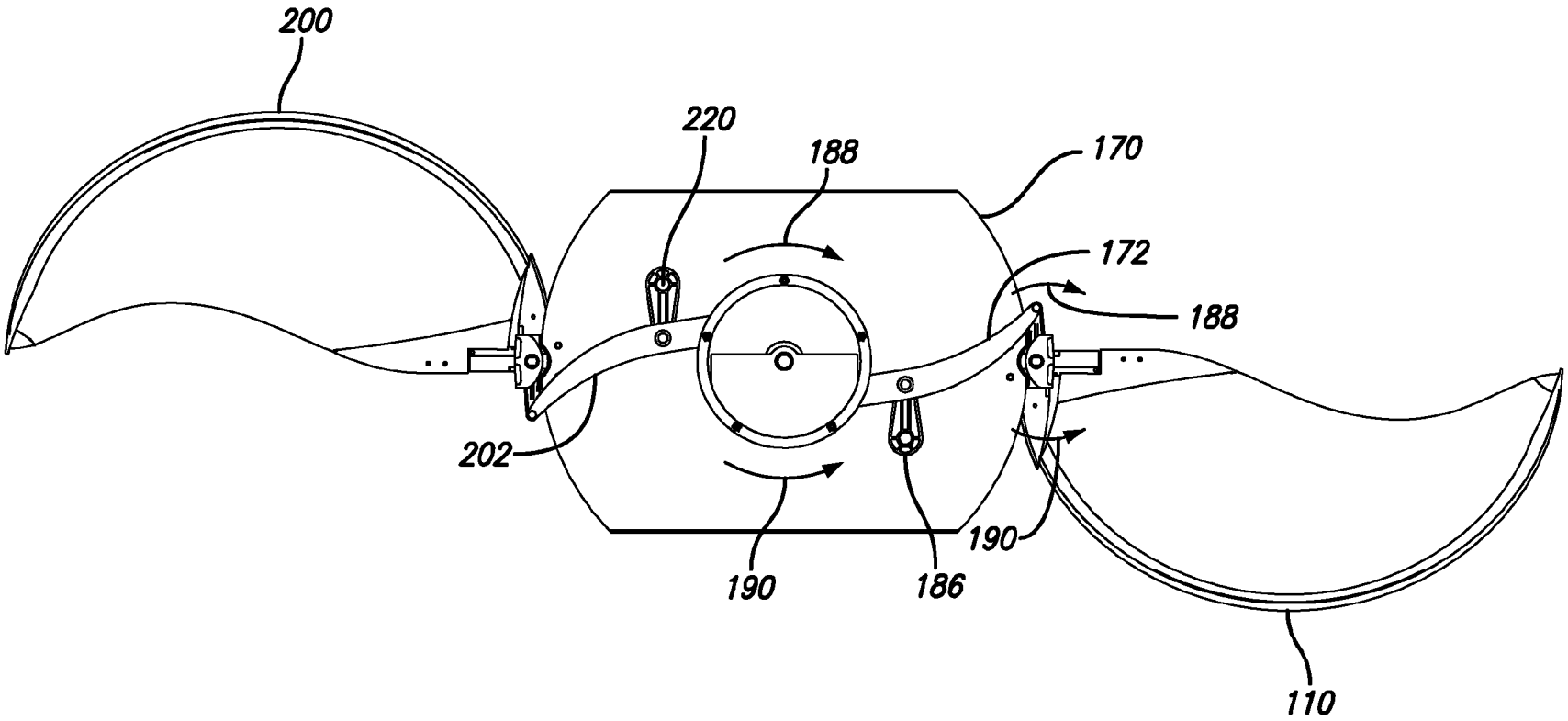
FIG. 5 is a top view of the fan shown in FIG. 1.
Figure 6:
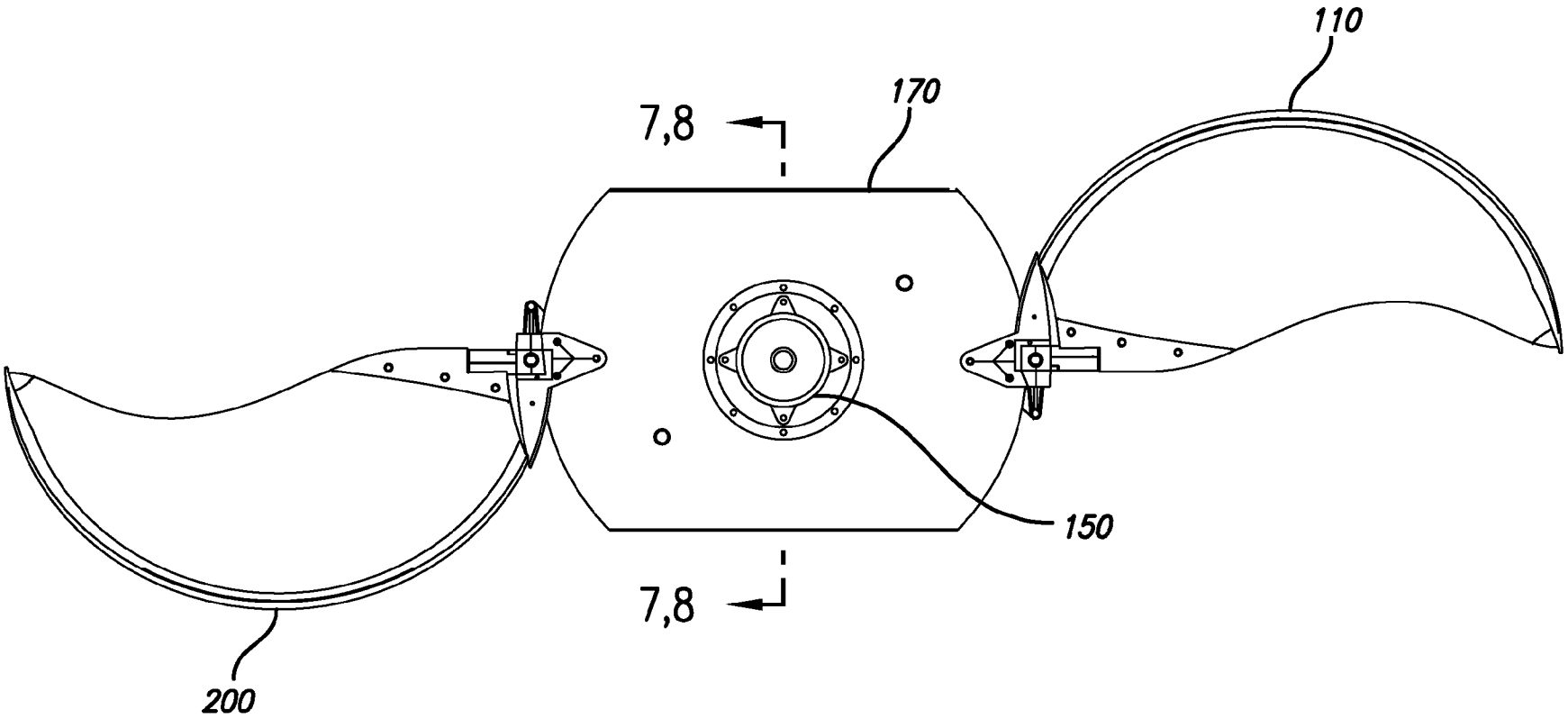
FIG. 6 is a bottom view of the fan shown in FIG. 1.
Figure 7:
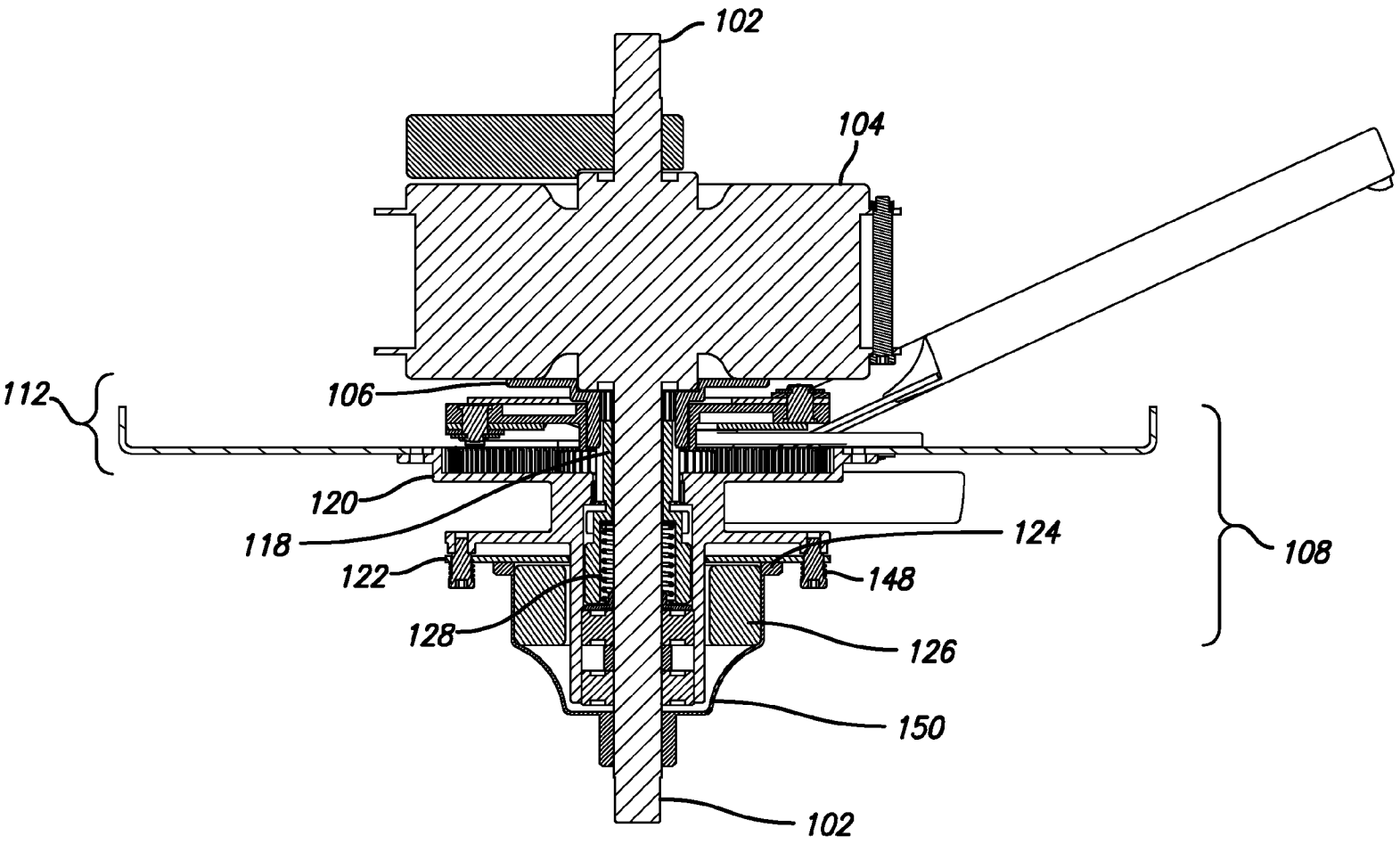
FIG. 7 is a sectional view of the fan taken along the line shown in FIG. 6 and depicting a state where the electromagnetic coil is energized.
Figure 8:
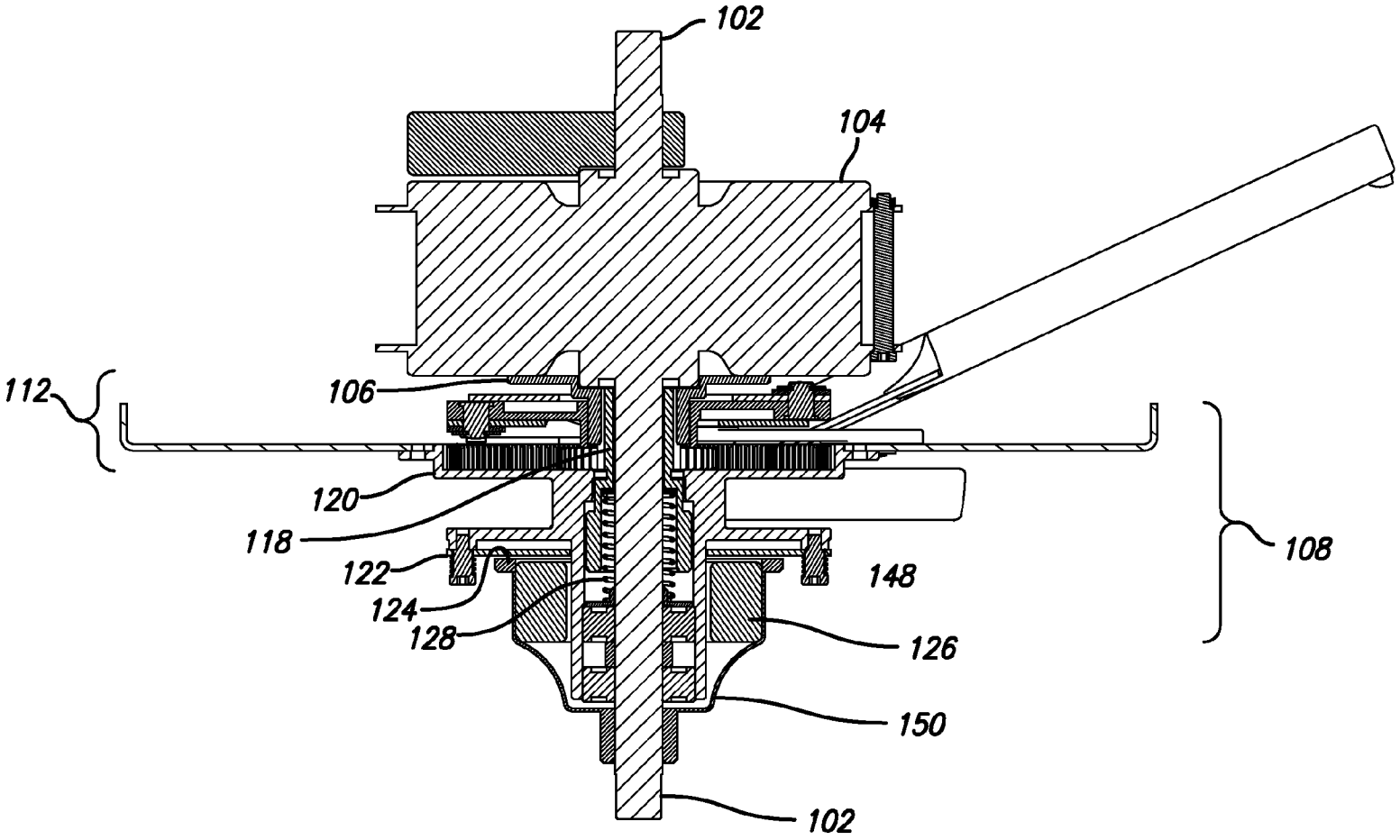
FIG. 8 is a sectional view of the fan shown in FIG. 1 taken along the line shown in FIG. 6 and depicting a state where the electromagnetic coil is de-energized.
Figure 9:
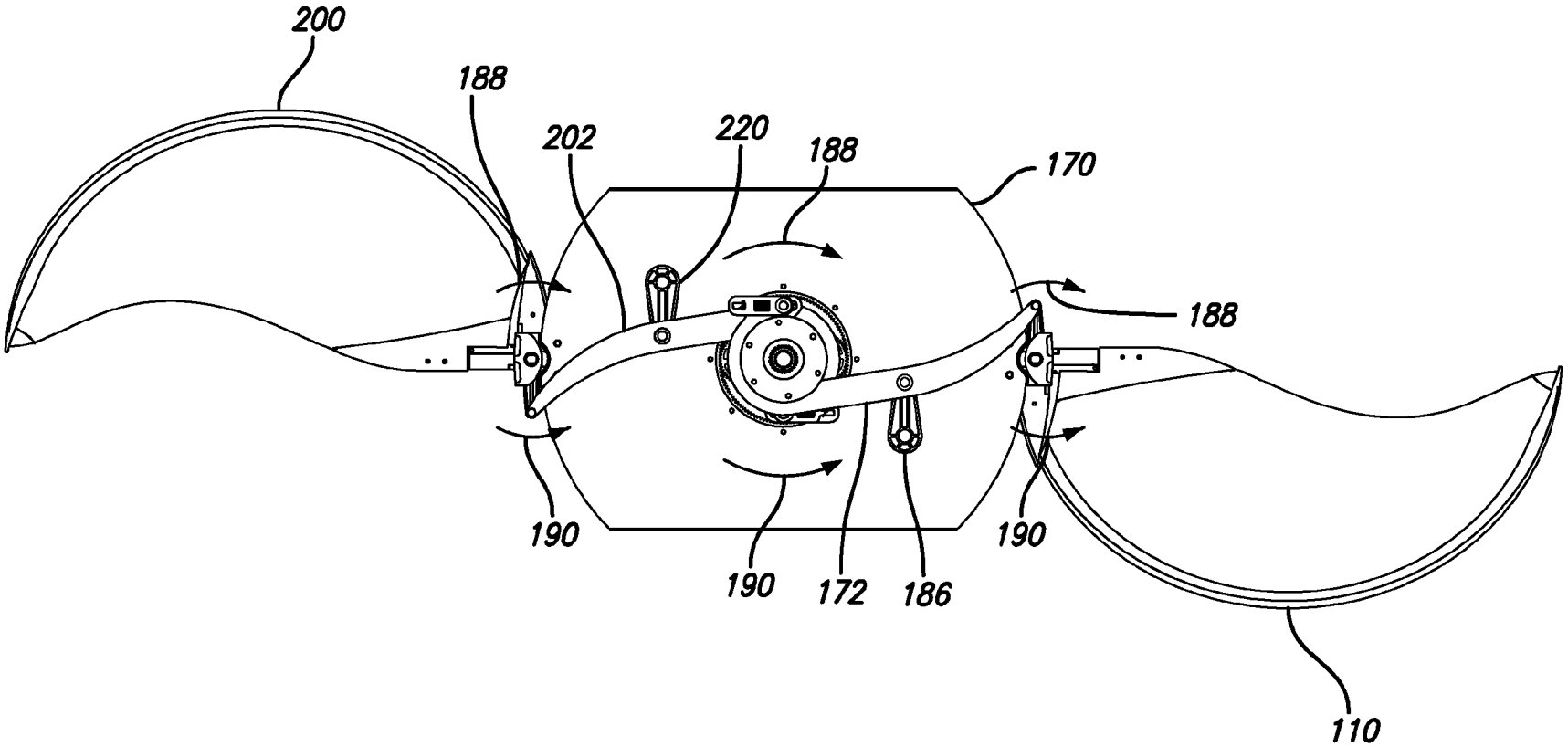
FIG. 9 is a top view of the fan shown in FIG. 1, except that the electric fan motor is not shown so that other components are more visible.
Figure 10:
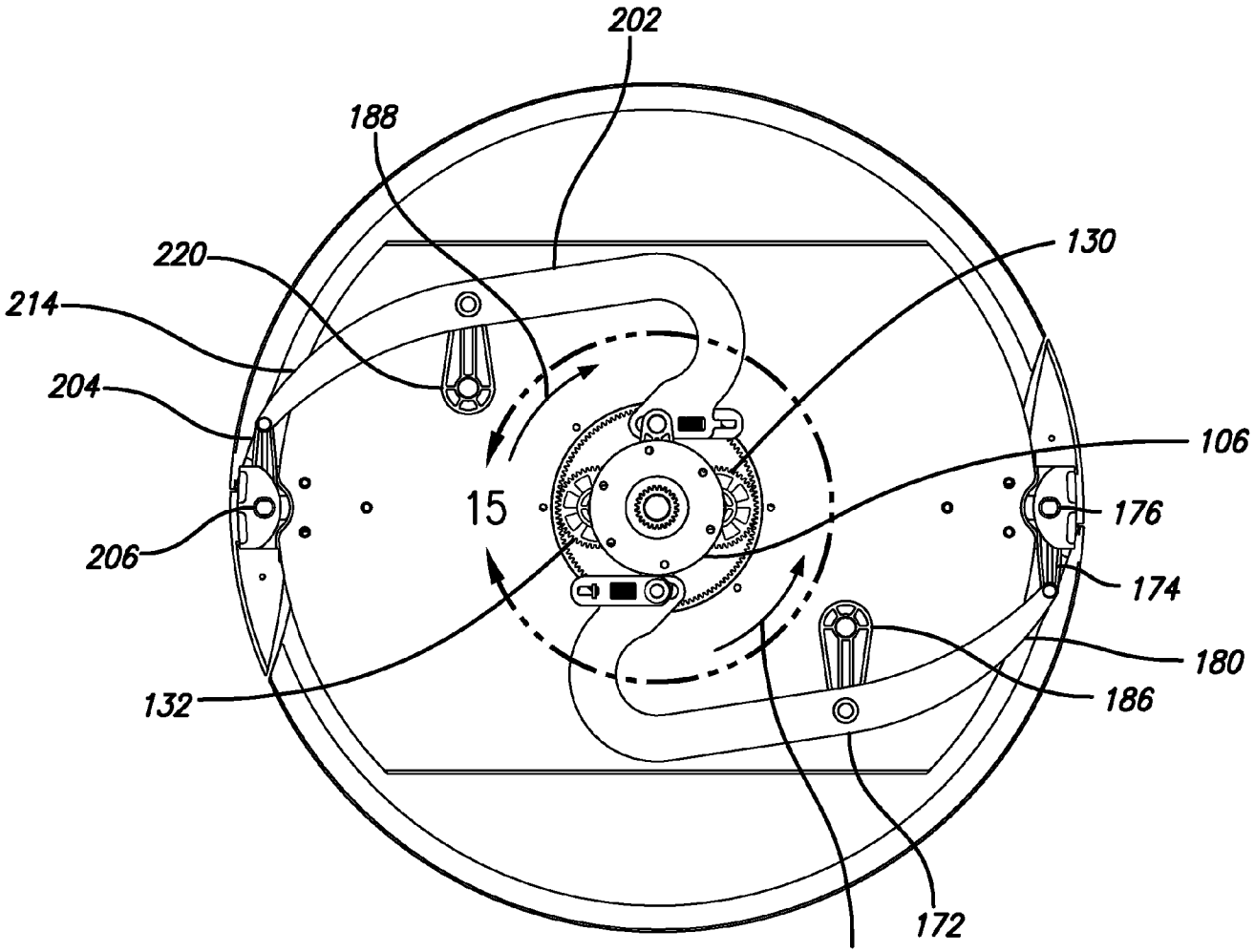
FIG. 10 is a top view of the fan shown in FIG. 2, except that the electric fan motor and the main fan plate are not shown so that other components are more visible.
Figure 11:
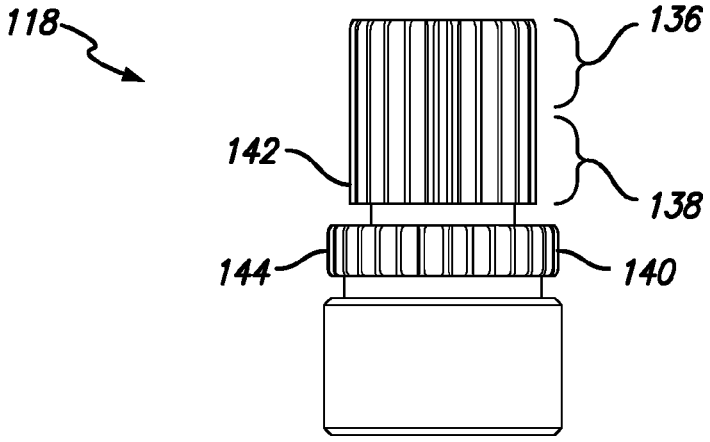
FIG. 11 is a view of the sun gear in isolation.
Figure 12:
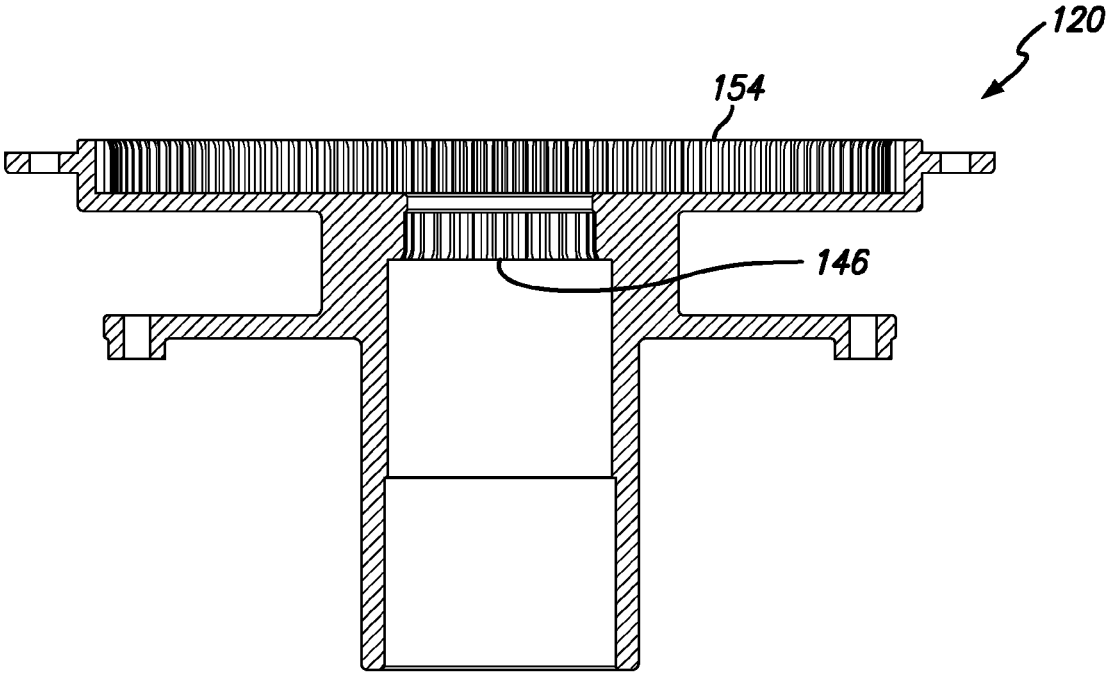
FIG. 12 is the sectional view of FIG. 7, but showing the ring gear housing in isolation.
Figure 13:
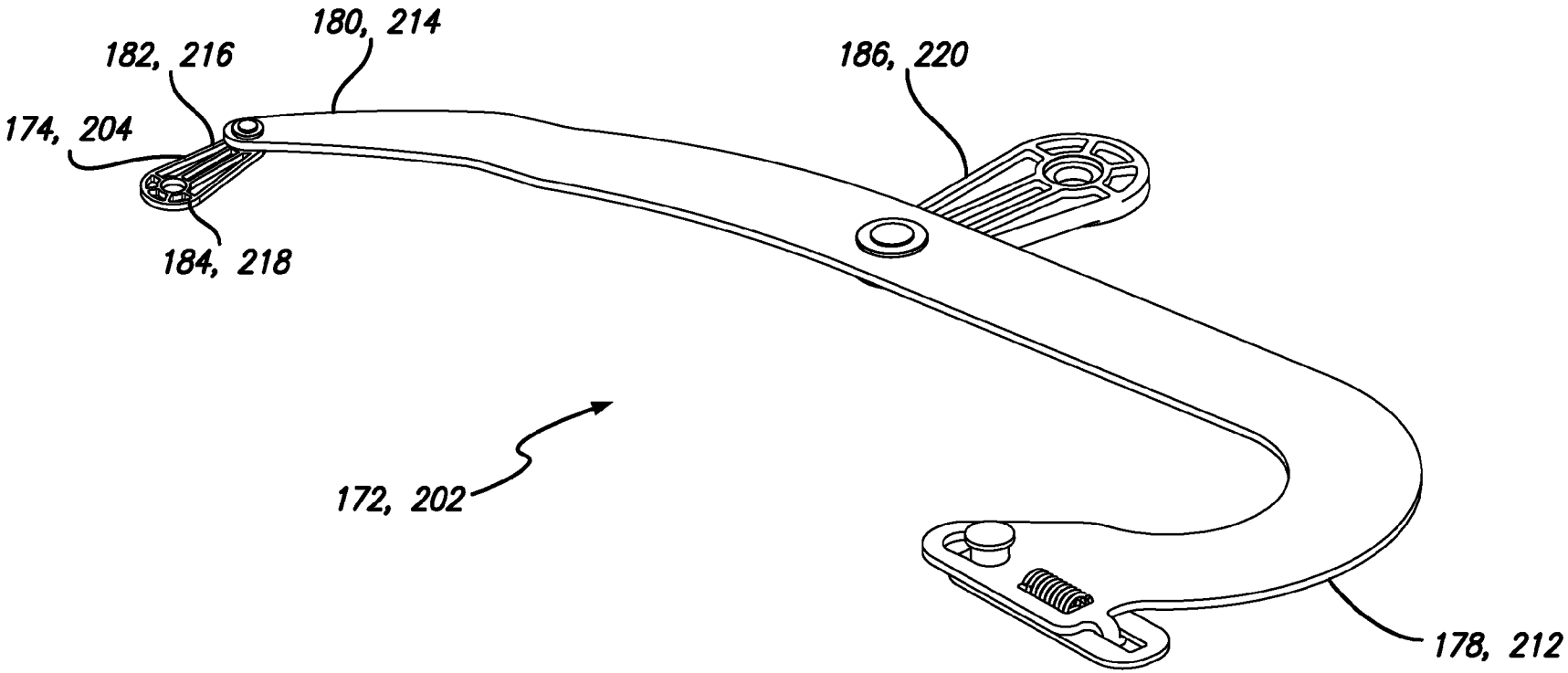
FIG. 13 is a perspective view of a drive link in isolation. The first drive link and the second drive link are preferably identical in geometry; so this figure includes the reference numbers for both drive links.
Figure 14:
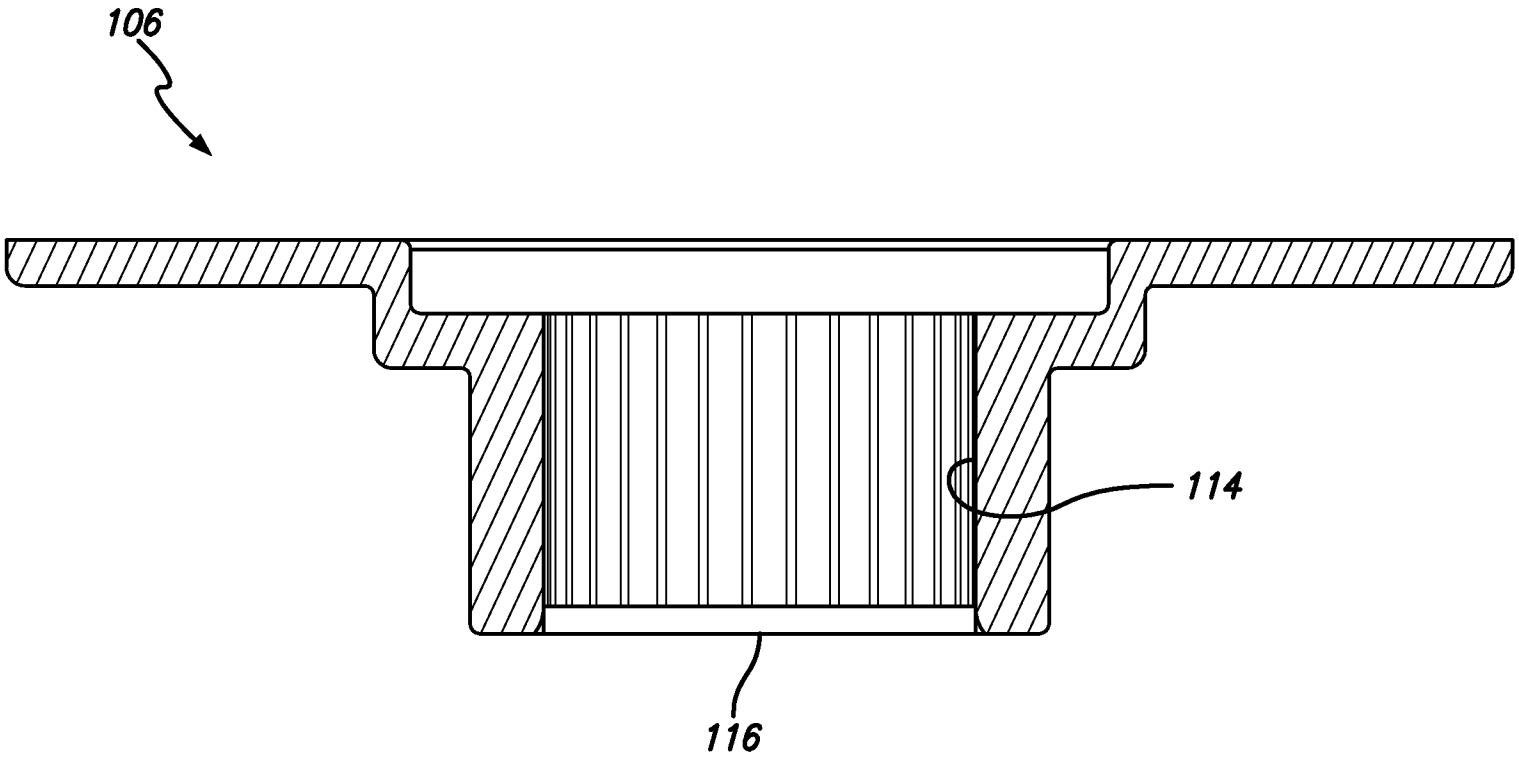
FIG. 14 is the sectional view of FIG. 7 but showing the motor hub in isolation.
Figure 15:
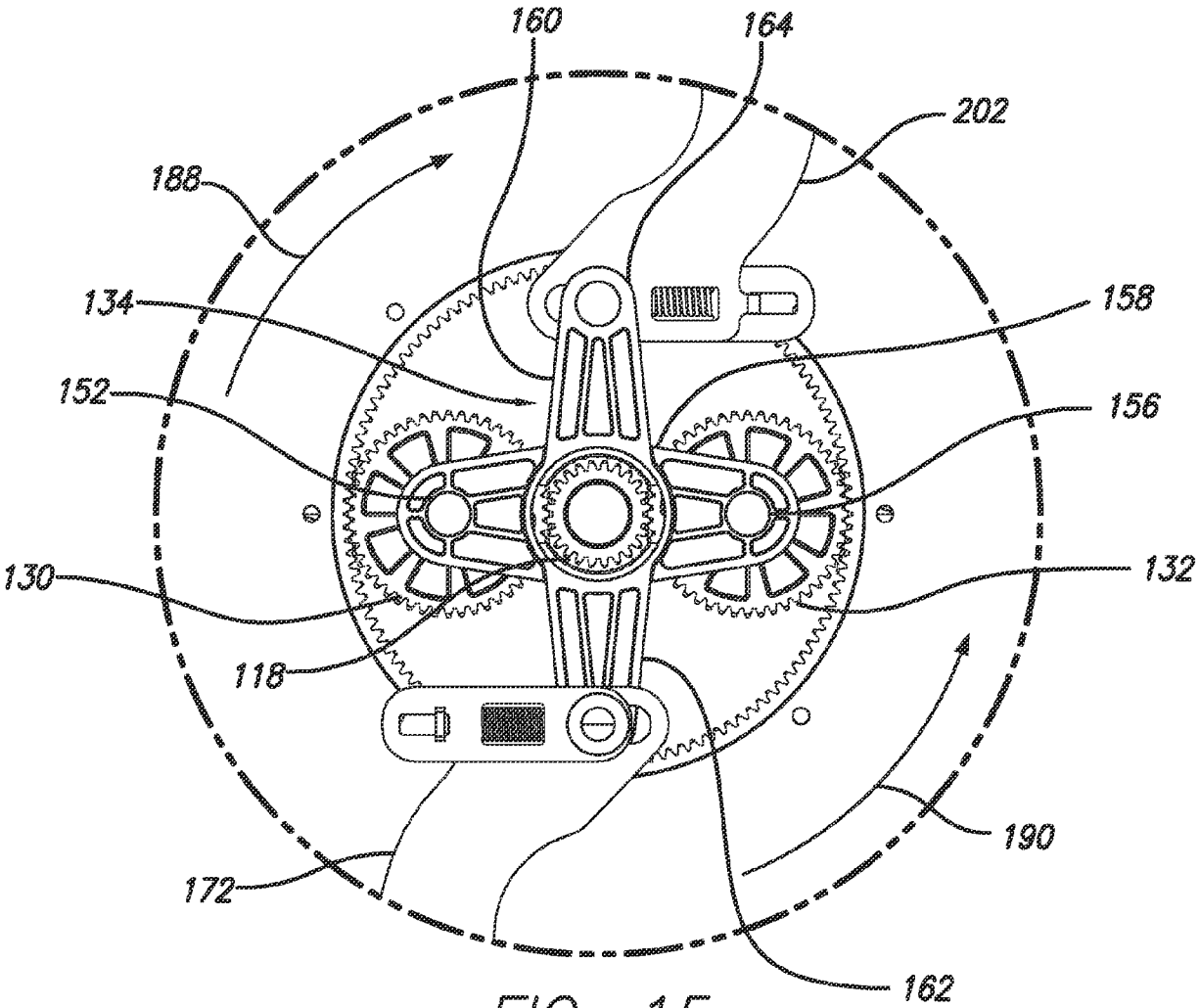
FIG. 15 is a magnified view of the portion of FIG. 0 indicated in that figure but also not showing the motor hub so that other components are more visible.

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

By reference to the attached figures, in a version of the invention an axial-flow, rotating fan 100 has a stationary motor shaft 102, an electric fan motor 104 mounted to and rotating about the motor shaft 102, a motor hub 106 connected to the fan motor and rotating about the motor shaft 102 with the fan motor, a transmission mechanism 108 connected to the motor hub 106, a first fan blade 110, and a blade deployment mechanism 112.

The motor shaft 102 is typically mounted to a ceiling or other support surface, with the remaining components being suspended from the ceiling. The motor hub 106 has an engagement surface 114. Preferably, the engagement surface 114 of the motor hub 106 is a series of internal splines 116 arranged radially about the motor shaft 102.

The transmission mechanism 108 includes a sun gear 118, a ring gear housing 120, a clutch plate 122, a contact surface 124, an electromagnetic coil 126, a sun gear spring 128, a first planet gear 130, and a second planet gear 132, and a planet gear carrier 134. In some versions, there are one, two, or more planet gears.

Other than a planetary system, the transmission mechanism 108 could be any sort of reduction geartrain or speed reduction drive. The speed reduction drive could include belts, gears, hydraulics, or other known methods. Also, there are several means for locking and unlocking the speed reduction drive (or transmission mechanism 108) to the electric fan motor 104. Other than the clutch mechanism described, such means include a spline or teeth the engage-disengage the sun gear 118 from the main fan plate 170. In addition, other than the electromagnetic coil 126, there are other selection mechanisms that can operatively control the means for locking and the means for unlocking the speed reduction drive. For example, an electric or hydraulic motor or linear actuator could move the sun gear 118.

The sun gear 118 has an engagement portion 136, a first geared portion 138, and a second geared portion 140. The engagement portion 136 is shaped and dimensioned to engage the engagement surface 114 of the motor hub 106. The first geared portion 138 of the sun gear 118 has a series of gear teeth 142 arranged radially about the motor shaft 102. The second geared portion 140 also has a series of gear teeth 144 arranged radially about the motor shaft 102. Preferably, the engagement portion 136 and the first geared portion 138 are the same series of gear teeth, as shown in the figures.

The ring gear housing 120 has a first internal spline 146 to engage the second geared portion 140 of the sun gear 118. The clutch plate 122 is connected to the ring gear housing 120 by a clutch plate spring 148. The clutch plate spring 148 provides spring resistance to the clutch plate 122 moving away from the ring gear housing 120. In a version of the invention, the clutch plate spring 148 is a helical compression spring.

The contact surface 124 is fixed to the motor shaft 102 and is adjacent to the clutch plate 122. Preferably, the contact surface 124 is an annular surface of a coil housing 150, the coil housing 150 is fixed to the motor shaft 102, and the electromagnetic coil 126 is within the coil housing 150.

The sun gear spring 128 provides a spring force to engage the engagement portion 136 of the sun gear 118 with the engagement surface 114 of the motor hub 106. In a version of the invention, the sun gear spring 128 is a helical compression spring between the sun gear 118 and the coil housing 150.

The first planet gear 130 is rotatively connected to the ring gear housing 120 about a first planet gear axle 152, and the first planet gear 130 engages a second internal spline 154 of the ring gear housing 120. The second internal spline 154 of the ring gear housing 120 is radially farther from the motor shaft 102 than the first geared portion 138 of the sun gear 118. The first planet gear 130 rotates about the first planet gear axle 152 and also revolves about the sun gear 118. The second planet gear 132 is rotatively connected to the ring gear housing 120 about a second planet gear axle 156. The second planet gear 132 also engages the second internal spline 154 of the ring gear housing 120. The second planet gear 132 rotates about the second planet gear axle 156 and also revolves about the sun gear 118.

The planet gear carrier 134 rigidly connects the first planet gear axle 152 and the second planet gear axle 156. In a version of the invention, the planet gear carrier 134 has a first arm 158 connecting the first planet gear axle 152 and the second planet gear axle 156, and a second arm 160 at an angle (preferably perpendicular) to the first arm 158 of the planet gear carrier 134. The second arm 160 has a first end 162 and an opposite second end 164.

The first fan blade 110 has a first fan blade tip 166 and a first fan blade root 168.

The blade deployment mechanism 112 includes a main fan plate 170, a first drive link 172, a first blade link 174, and a first blade pivot assembly 176.

The main an plate 170 is connected to the ring gear housing 120. The first drive link 172 has a first, curved end 178 and an opposite second end 180. The first end 178 of the first drive link 172 is connected to the planet gear carrier 134. In some versions of the invention, the first end 178 of the first drive link 172 is connected to the first end 162 of the second arm 160 of the planet gear carrier 134. The first blade link 174 is pivotally connected to the second end 180 of the first drive link 172 at an end 182 of the first blade link 174.

The first blade pivot assembly 176 is mounted to the main fan plate 170, and the first blade pivot assembly 176 is connected to an opposite end 184 of the first blade link 174. The first blade pivot assembly 176 pivotally connects the first fan blade 110 to the main fan plate 170 at the first fan blade root 168.

In a version of the invention, the blade deployment mechanism 112 also has a first idler arm 186. The first idler arm 186 is connected to the first drive link 172, and the first idler arm 186 is between the first end 178 and the second end 180 of the first drive link 172. The first idler arm 186 pivotally connects the first drive link 172 to the main fan plate 170.

Preferably, the fan also includes a second fan blade 200, a second drive link 202, a second blade link 204, and a second blade pivot assembly 206. The second fan blade 200 has a second fan blade tip 208 and a second fan blade root 210. The second drive link 202 has a first, curved end 212 and an opposite second end 214. The first end 212 of the second drive link 202 is connected to the planet gear carrier 134. In some versions of the invention, the first end 212 of the second drive link 202 is connected to the second end 164 of the second arm 160 of the planet gear carrier 134. The second blade link 204 is pivotally connected to the second end 214 of the second drive link 202 at an end 216 of the second blade link 204. The second blade pivot assembly 206 is mounted to the main fan plate 170. The second blade pivot assembly 206 is connected to an opposite end 218 of the second blade link 204. The second blade pivot assembly 206 pivotally connects the second fan blade 200 to the main fan plate 170 at the second fan blade root 210.

This version of the invention may also include a second idler arm 220. The second idler arm 220 is connected to the second drive link 202. The second idler arm 220 is between the first end 212 and the second end 214 of the second drive link 202. The second idler arm 220 pivotally connects the second drive link 202 to the main fan plate 170.

During use, the engagement portion 136 of the sun gear 118 slides within the motor hub 106 while continuously engaging the engagement surface 114 of the motor hub 106. The second geared portion 140 of the sun gear 118 slides within the ring gear housing 120 to engage and disengage the first internal spline 146 of the ring gear housing 120.

In an energized state, the electromagnetic coil 126 is energized and generates a magnetic force. The clutch plate 122 is in contact with the contact surface 124 due to the magnetic force of the electromagnetic coil 126, and the sun gear 118 is disengaged from the first internal spline 146 of the ring gear housing 120 due to the magnetic force of the electromagnetic coil 126. The sun gear 118 is attracted to the electromagnetic coil 126 like an armature is attracted to an energized solenoid.

In a de-energized state, the electromagnetic coil 126 is de-energized and does not generate the magnetic force. The clutch plate 122 is not in contact with the contact surface 124 due to the spring resistance of the clutch plate spring 148, and the sun gear 118 is engaged with the first internal spline 146 of the ring gear housing 120 due to the spring force of the sun gear spring 128.

In a deployed configuration or state, the first end 178 of the first drive link 172 rotates about the motor shaft 102 in a first rotative direction 188 and activates the first blade link 174 to rotate in the first rotative direction 188 about the first blade pivot assembly 176. The first blade link 174 causes the first fan blade 110 to pivot about the first blade pivot assembly 176 in the first rotative direction 188. The result is that the first fan blade tip 166 is farther from the motor shaft 102 than the first fan blade root 168. Likewise, the first end 212 of the second drive link 202 rotates about the motor shaft 102 in the first rotative direction 188 and activates the second blade link 204 to rotate in the first rotative direction 188 about the second blade pivot assembly 206. The second blade link 204 causes the second fan blade 200 to pivot about the second blade pivot assembly 206 in the first rotative direction 188. The result is that the second fan blade tip 208 is farther from the motor shaft 102 than the second fan blade root 210.

In a retracted configuration or state, the first end 178 of the first drive link 172 rotates about the motor shaft 102 in a second rotative direction 190 and activates the first blade link 174 to rotate in the second rotative direction 190 about the first blade pivot assembly 176. The first blade link 174 causes the first fan blade 110 to pivot about the first blade pivot assembly 176 in the second rotative direction 190. The result is that the first fan blade tip 166 is equidistant from the motor shaft 102 as the first fan blade root 168. Likewise, the first end 212 of the second drive link 202 rotates about the motor shaft 102 in the second rotative direction 190 and activates the second blade link 204 to rotate in the second rotative direction 190 about the second blade pivot assembly 206. The second blade link 204 causes the second fan blade 200 to pivot about the second blade pivot assembly 206 in the second rotative direction 190. The result is that the second fan blade tip 208 is equidistant from the motor shaft 102 as the second fan blade root 210. In a version of the invention, the first fan blade 110 slides between the main fan plate 170 and the clutch plate 122, and the second fan blade 200 slides between the main fan plate 170 and the clutch plate 122. Preferably, each of the first fan blade 110 and the second fan blade 200 is shaped and dimensioned to together form a disk symmetrical about the motor shaft 102 in the retracted configuration or state.

Once the fan blades are deployed, the electromagnetic coil 126 is de-energized as described above. Since the sun gear 118 is engaged with the first internal spline 146 of the ring gear housing 120, the ring gear housing 120 rotates with the sun gear 118. Because the main fan plate 170 is connected to the ring gear housing 120, and each of the first fan blade 110 and the second fan blade 200 is connected to the main fan plate 170, the fan blades rotate with the sun gear 118 for conventional operation of the fan.

In another aspect of the invention, a method of deploying and retracting the fan blades of a fan includes the steps of providing a fan with the features discussed above. The method also includes the steps of: (a) energizing the electromagnetic coil 126 to produce a magnetic force; (b) the magnetic force pulling the clutch plate 122 in contact with the contact surface 124, thereby locking the ring gear housing 120 to the motor shaft 102 via the coil housing 150; (c) the magnetic force also pulling the sun gear 118 toward the electromagnetic coil 126, thus disengaging the sun gear 118 from the first internal spline 146 of the ring gear housing 120; (d) operating the electric fan motor 104 in a first rotative direction 188; (e) the electric fan motor 104 thereby turning the motor hub 106 and the sun gear 118 about the motor shaft 102 in the first rotative direction 188, the sun gear 118 engaging the first planet gear 130 and the second planet gear 132 causing the first planet gear 130 and the second planet gear 132 to revolve around the sun gear 118 in a second rotative direction 190 opposite to the first rotative direction 188, which causes the planet gear carrier 134 to rotate about the motor shaft 102 in the first rotative direction 188; (f) the rotating planet gear carrier 134 thereby activating the first drive link 172 and the second drive link 202, the first end 178 of the first drive link 172 rotating about the motor shaft 102 in the first rotative direction 188 and activating the first blade link 174 to rotate in the first rotative direction 188 about the first blade pivot assembly 176, thereby pivoting the first fan blade 110 about the first blade pivot assembly 176 in the first rotative direction 188 and into a deployed configuration where the first fan blade tip 166 is farther from the motor shaft 102 than the first fan blade root 168, the first end 212 of the second drive link 202 rotating about the motor shaft 102 in the first rotative direction 188 and activating the second blade link 204 to rotate in the first rotative direction 188 about the second blade pivot assembly 206, thereby pivoting the second fan blade 200 about the second blade pivot assembly 206 in the first rotative direction 188 and into the deployed configuration where the second fan blade tip 208 is farther from the motor shaft 102 than the second fan blade root 201; (g) de-energizing the electromagnetic coil 126; (h) the plurality of clutch plate springs 148 pushing the clutch plate 122 toward the ring gear housing 120 and out of contact with the contact surface 124, thereby unlocking the ring gear housing 120 from the motor shaft 102 and the coil housing 150; (i) the sun gear spring 128 pushing the sun gear 118 away from the electromagnetic coil 126 and toward the electric fan motor 104 to engage the sun gear 118 with the first internal spline 146 of the ring gear housing 120; (j) operating the electric fan motor 104 to revolve the first fan blade 110 and the second fan blade 200 about the motor shaft 102 for a desired period of time; (k) stopping the electric fan motor 104; (l) energizing the electromagnetic coil 126 to produce the magnetic force; (m) the magnetic force pulling the clutch plate 122 in contact with the contact surface 124, thereby locking the ring gear housing 120 to the motor shaft 102 via the coil housing 150; (n) the magnetic force pulling the sun gear 118 toward the electromagnetic coil 126, thus disengaging the sun gear 118 from the first internal spline 146 of the ring gear housing 120; (o) operating the electric fan motor 104 in the second rotative direction 190; (p) the electric fan motor 104 thereby turning the sun gear 118 about the motor shaft 102 in the second rotative direction 190, the sun gear 118 engaging the first planet gear 130 and the second planet gear 132, causing the first planet gear 130 and the second planet gear 132 to revolve around the sun gear 118 in the first rotative direction 188, which causes the planet gear carrier 134 to rotate about the motor shaft 102 in the second rotative direction 190; and (q) the rotating planet gear carrier 134 thereby activating the first drive link 172 and the second drive link 202, the first end 178 of the first drive link 172 rotating about the motor shall 102 in the second rotative direction 190 and activating the first blade link 174 to rotate in the second rotative direction 190 about the first blade pivot assembly 176, thereby pivoting the first fan blade 110 about the first blade pivot assembly 176 in the second rotative direction 190 and into a retracted configuration where the first fan blade tip 166 is equidistant from the motor shaft 102 as the first fan blade root 168, and the first end 212 of the second drive link 202 rotating about the motor shaft 102 in the second rotative direction 190 and activating the second blade link 204 to rotate in the second rotative direction 190 about the second blade pivot assembly 206, thereby pivoting the second fan blade 200 about the second blade pivot assembly 206 in the second rotative direction 190 and into the retracted configuration where the second fan blade tip 208 is equidistant from the motor shaft 102 as the second fan blade root 210.

While the present invention has been described with regards to particular embodiments, it is recognized that additional variations of the present invention may be devised without departing from the inventive concept.

INDUSTRIAL APPLICABILITY

This invention may be industrially applied to the development, manufacture, and use of axial-flow, rotating fans, particularly ceiling fans.

What is claimed is:

1. An axial-flow, rotating ceiling fan comprising:

(a) a stationary motor shaft having a top end for mounting to a horizontal surface and an opposite, bottom end suspended from the horizontal surface;

(b) an electric fan motor rotating about the motor shaft and located at the top end of the motor shaft;

(c) a motor hub rigidly connected to a bottom surface of the fan motor and rotating about the motor shaft with the fan motor, the motor hub having internal splines comprising a series of grooves arranged radially about the motor shaft;

(d) a transmission mechanism connected to the motor hub, the transmission mechanism comprising:

(i) a sun gear, the sun gear surrounding the motor shaft and having a first geared portion and a second geared portion, the first geared portion of the sun gear having a series of gear teeth arranged radially about the motor shaft to engage the internal splines of the motor hub, the second gear portion also having a series of gear teeth arranged radially about the motor shaft;

(ii) a ring gear housing surrounding the motor shaft, the ring gear housing having a first internal spline to engage the second geared portion of the sun gear;

(iii) a clutch plate surrounding the motor shaft and connected to the ring gear housing by a plurality of clutch plate springs, each clutch plate spring comprising a helical compression spring, the clutch plate springs providing spring resistance to the clutch plate moving away from the ring gear housing;

(iv) a coil housing surrounding and fixed to the motor shaft at the bottom end of the motor shaft, an upper end of the coil housing being adjacent and parallel to the clutch plate;

(v) an electromagnetic coil surrounding the motor shaft within the coil housing, the electromagnetic coil being adjacent to the clutch plate;

(vi) a sun gear spring, the sun gear spring comprising a helical compression spring surrounding the motor shaft between the sun gear and a bottom end of the coil housing, the sun gear spring providing a spring force to push the sun gear away from the bottom end of the coil housing;

(vii) a pair of planet gears denoted here as a first planet gear and a second planet gear, the first planet gear rotatively connected to the ring gear housing about a first planet gear axle, the second planet gear rotatively connected to the ring gear housing about a second planet gear axle, the first planet gear and the second planet gear engaging the first geared portion of the sun gear on opposite sides of the sun gear, the first planet gear engaging a second internal spline of the ring gear housing, the second internal spline of the ring gear housing being radially farther from the motor shaft than the first geared portion of the sun gear, the second planet gear also engaging the second internal spline of the ring gear housing, the first planet gear rotating about the first planet gear axle and also revolving about the sun gear, the second planet gear rotating about the second planet gear axle and also revolving about the sun gear; and (viii) a planet gear carrier symmetrically surrounding the motor shaft and comprising a first arm rigidly connecting the two planet gear axles and a second arm rigidly connected and perpendicular to the first arm of the planet gear carrier, the second arm having a first end and an opposite second end;

(e) a pair of fan blades arranged symmetrically about the motor shaft and denoted here as a first fan blade and a second fan blade, the first fan blade having a first fan blade tip and a first fan blade root, the second fan blade having a second fan blade tip and a second fan blade root;

(f) a blade deployment mechanism comprising:

(i) a main fan plate rigidly connected to the ring gear housing;

(ii) a pair of drive links denoted here as a first drive link and a second drive link, each of the first drive link and the second drive link having a first, curved end and an opposite second end, the first end of the first drive link being connected to the first end of the second arm of the planet gear carrier, the first end of the second drive link being connected to the second end of the second arm of the planet gear carrier;

(iii) a pair of idler arms denoted here as a first idler arm and a second idler arm, the first idler arm being connected to the first drive link, the second idler arm being connected to the second drive link, the first idler arm being between the first end and the second end of the first drive link, the first idler arm pivotally connecting the first drive link to the main fan plate, the second idler arm being between the first end and the second end of the second drive link, the second idler arm pivotally connecting the second drive link to the main fan plate;

(iv) a pair of blade links denoted here as a first blade link and a second blade link, the first blade link being pivotally connected to the second end of the first drive link at an end of the first blade link, the second blade link being pivotally connected to the second end of the second drive link at an end of the second blade link; and (v) a pair of blade pivot assembly assemblies mounted to the main fan plate, denoted here as a first blade pivot assembly and a second blade pivot assembly, the first blade pivot assembly being connected to an opposite end of the first blade link, the second blade pivot assembly being connected to an opposite end of the second blade link, the first blade pivot assembly pivotally connecting the first fan blade to the main fan plate at the first fan blade root, the second blade pivot assembly pivotally connecting the second fan blade to the main fan plate at the second fan blade root;

wherein the sun gear slides within the motor hub while engaging the internal splines of the motor hub;

wherein the sun gear slides within the ring gear housing to engage and disengage the first internal spline of the ring gear housing;

wherein in an energized state, the electromagnetic coil is energized and generates a magnetic force, the clutch plate is in contact with the upper end of the coil housing due to the magnetic force of the electromagnetic coil, and the sun gear is disengaged from the first internal spline of the ring gear housing due to the magnetic force of the electromagnetic coil;

wherein in a de-energized state, the electromagnetic coil is de-energized and does not generate the magnetic force, the clutch plate is not in contact with the upper end of the coil housing due to the spring resistance of the clutch plate springs, and the sun gear is engaged with the first internal spline of the ring gear housing due to the spring force of the sun gear spring;

wherein in a deployed state, the first end of the first drive link rotates about the motor shaft in a first rotative direction and activates the first blade link to rotate in the first rotative direction about the first blade pivot assembly, the first blade link causes the first fan blade to pivot about the first blade pivot assembly in the first rotative direction, the result being that the first fan blade tip is farther from the motor shaft than the first fan blade root, likewise the first end of the second drive link rotates about the motor shaft in the first rotative direction and activates the second blade link to rotate in the first rotative direction about the second blade pivot assembly, the second blade link causes the second fan blade to pivot about the second blade pivot assembly in the first rotative direction, the result being that the second fan blade tip is farther from the motor shaft than the second fan blade root; and wherein in a retracted state, the first end of the first drive link rotates about the motor shaft in a second rotative direction and activates the first blade link to rotate in the second rotative direction about the first blade pivot assembly, the first blade link causes the first fan blade to pivot about the first blade pivot assembly in the second rotative direction, the first fan blade sliding between the main fan plate and the clutch plate, the result being that the first fan blade tip is equidistant from the motor shaft as the first fan blade root, likewise the first end of the second drive link rotates about the motor shaft in the second rotative direction and activates the second blade link to rotate in the second rotative direction about the second blade pivot assembly, the second blade link causes the second fan blade to pivot about the second blade to pivot assembly in the second rotative direction, the second fan blade sliding between the main fan plate and the clutch plate, the result being that the second fan blade tip is equidistant from the motor shaft as the second fan blade root, each of the first fan blade and the second fan blade being shaped and dimensioned to together form a disk symmetrical about the motor shaft in the in retracted state.

2. An axial-flow, rotating fan comprising:

(a) a stationary motor shaft;

(b) an electric fan motor mounted to and rotating about the motor shaft;

(c) a motor hub connected to the fan motor and rotating about the motor shaft with the fan motor, the motor hub having an engagement surface;

(d) a transmission mechanism connected to the motor hub, the transmission mechanism comprising:

(i) a sun gear, the sun gear having an engagement portion, a first geared portion, and a second geared portion, the engagement portion being shaped and to dimensioned to engage the engagement surface of the motor hub, the first geared portion of the sun gear having a series of gear teeth arranged radially about the motor shaft, the second gear portion also having a series of gear teeth arranged radially about the motor shaft;

(ii) a ring gear housing, the ring gear housing having a first internal spline to engage the second geared portion of the sun gear;

(iii) a clutch plate connected to the ring gear housing by a clutch plate spring, the clutch plate spring providing spring resistance to the clutch plate moving away from the ring gear housing;

(iv) a contact surface fixed to the motor shaft and being adjacent to the clutch plate;

(v) an electromagnetic coil;

(vi) a sun gear spring; the sun gear spring providing a spring force to engage the engagement portion of the sun gear with the engagement surface of the motor hub;

(vii) a first planet gear and a second planet gear, the first planet gear being rotatively connected to the ring gear housing about a first planet gear axle, the first planet gear engaging a second internal spline of the ring gear housing, the second internal spline of the ring gear housing being radially farther from the motor shaft than the first geared portion of the sun gear, the first planet gear rotating about the first planet gear axle and also revolving about the sun gear, the second planet gear rotatively connected to the ring gear housing about a second planet gear axle, the second planet gear also engaging the second internal spline of the ring gear housing, the second planet gear rotating about the second planet gear axle and also revolving about the sun gear; and (viii) a planet gear carrier connecting the first planet gear axle and the second planet gear axle;

(e) a first fan blade, the first fan blade having a first fan blade tip and a first fan blade root;

(f) a blade deployment mechanism comprising:

(i) a main fan plate connected to the ring gear housing;

(ii) a first drive link, the first drive link having a first, curved end and an opposite second end, the first end of the first drive link being connected to the planet gear carrier;

(iii) a first blade link, the first blade link being pivotally connected to the second end of the first drive link at an end of the first blade link; and (iv) a first blade pivot assembly mounted to the main fan plate, the first blade pivot assembly being connected to an opposite end of the first blade link, the first blade pivot assembly pivotally connecting the first fan blade to the main fan plate at the first fan blade root;

wherein the engagement portion of the sun gear slides within the motor hub while continuously engaging the engagement surface of the motor hub;

wherein the second geared portion of the sun gear slides within the ring gear housing to engage and disengage the first internal spline of the ring gear housing;

wherein in an energized state, the electromagnetic coil is energized and generates a magnetic force, the clutch plate is in contact with the contact surface due to the magnetic force of so the electromagnetic coil, and the sun gear is disengaged from the first internal spline of the ring gear housing due to the magnetic force of the electromagnetic coil; and wherein in a de-energized state, the electromagnetic coil is de-energized and does not generate the magnetic force, the clutch plate is not in contact with the contact surface due to the spring resistance of the clutch plate spring, and the sun gear is engaged with the first internal spline of the ring gear housing due to the spring force of the sun gear spring.

3. The fan of claim 2, the engagement surface of the motor hub comprising a series of internal splines.

4. The fan of claim 2, the clutch plate spring comprising a helical compression spring.

5. The fan of claim 2, the blade deployment mechanism further comprising a first idler arm, the first idler arm being connected to the first drive link, the first idler arm being between the first end and the second end of the first drive link, the first idler arm pivotally connecting the first drive link to the main fan plate.

6. The fan of claim 2, the contact surface being an annular surface of a coil housing, the coil housing being fixed to the motor shaft, the electromagnetic coil being within the coil housing.

7. The fan of claim 6, the sun gear spring comprising a helical compression spring between the sun gear and the coil housing.

8. The fan of claim 2, the planet gear carrier comprising:

(a) a first arm rigidly connecting the first planet gear axle and the second planet gear axle, and (b) a second arm perpendicular to the first arm of the planet gear carrier, the second arm having a first end and an opposite second end, where the first end of the first drive link is connected to the first end of the second arm of the planet gear carrier.

9. The fan of claim 2 further comprising:

(a) a second fan blade, the second fan blade having a second fan blade tip and a second fan blade root;

(b) a second drive link, the second drive link having a first, curved end and an opposite second end, the first end of the second drive link being connected to the second end of the second arm of the planet gear carrier;

(c) a second blade link, the second blade link being pivotally connected to the second end of the second drive link at an end of the second blade link; and (d) a second blade pivot assembly mounted to the main fan plate, the second blade pivot assembly being connected to an opposite end of the second blade link, the second blade pivot assembly pivotally connecting the second fan blade to the main fan plate at the second fan blade root.

10. The fan of claim 9 further comprising a second idler arm, the second idler arm being connected to the second drive link, the second idler arm being between the first end and the second end of the second drive link, the second idler arm pivotally connecting the second drive link to the main fan plate.

11. The fan of claim 9, wherein in a deployed configuration, the first end of the first drive link rotates about the motor shaft in a first rotative direction and activates the first blade link to rotate in the first rotative direction about the first blade pivot assembly, the first blade link causes the first fan blade to pivot about the first blade pivot assembly in the first rotative direction, the result being that the first fan blade tip is farther from the motor shaft than the first fan blade root, likewise the first end of the second drive link rotates about the motor shaft in the first rotative direction and activates the second blade link to rotate in the first rotative direction about the second blade pivot assembly, the second blade link causes the second fan blade to pivot about the second blade pivot assembly in the first rotative direction, the result being that the second fan blade tip is farther from the motor shaft than the second fan blade root; and wherein in a retracted configuration, the first end of the first drive link rotates about the motor shaft in a second rotative direction and activates the first blade link to rotate in the second rotative direction about the first blade pivot assembly, the first blade link causes the first fan blade to pivot about the first blade pivot assembly in the second rotative direction, the result being that the first fan blade tip is equidistant from the motor shaft as the first fan blade root, likewise the first end of the second drive link rotates about the motor shaft in the second rotative direction and activates the second blade link to rotate in the second rotative direction about the second blade pivot assembly, the second blade link causes the second fan blade to pivot about the second blade pivot assembly in the second rotative direction, the result being that the second fan blade tip is equidistant from the motor shaft as the second fan blade root.

12. The fan of claim 11, the first fan blade sliding between the main fan plate and the clutch plate in the retracted configuration and the second fan blade sliding between the main fan plate and the clutch plate.

13. The fan of claim 11, each of the first fan blade and the second fan blade being shaped and dimensioned to together form a disk symmetrical about the motor shaft in the retracted configuration.

14. A method for deploying and retracting fan blades of a ceiling fan, the method comprising the steps of:

(a) providing a ceiling fan having:

(i) a stationary motor shaft having a top end for mounting to a horizontal surface and an opposite, bottom end suspended from the horizontal surface;

(ii) an electric fan motor rotating about the motor shaft and located at the top end of the motor shaft;

(iii) a motor hub rigidly connected to a bottom surface of the fan motor and rotating about the motor shaft with the fan motor, the motor hub having internal splines comprising a series of grooves arranged radially about the motor shaft;

(iv) a transmission mechanism connected to the motor hub, the transmission mechanism comprising: (A) a sun gear, the sun gear surrounding the motor shaft and having a first geared portion and a second geared portion, the first geared portion of the sun gear having a series of gear teeth arranged radially about the motor shaft to engage the internal splines of the motor hub, the second gear portion also having a series of gear teeth arranged radially about the motor shaft; (B) a ring gear housing surrounding the motor shall, the ring gear housing having a first internal spline to engage the second geared portion of the sun gear; (C) a clutch plate surrounding the motor shaft and connected to the ring gear housing by a plurality of clutch plate springs, each clutch plate spring comprising a helical compression spring, the clutch plate springs providing spring resistance to the clutch plate moving away from the ring gear housing; (D) a coil housing surrounding and fixed to the motor shaft at the bottom end of the motor shaft, an upper end of the coil housing being adjacent and parallel to the clutch plate; (E) an electromagnetic coil surrounding the motor shaft within the coil housing, the electromagnetic coil being adjacent to the clutch plate; (F) a sun gear spring, the sun gear spring comprising a helical compression spring surrounding the motor shaft between the sun gear and a bottom end of the coil housing, the sun gear spring providing a spring force to push the sun gear away from the bottom end of the coil housing; (G) a pair of planet gears denoted here as a first planet gear and a second planet gear, the first planet gear rotatively connected to the ring gear housing about a first planet gear axle, the second planet gear rotatively connected to the ring gear housing about a second planet gear axle, the first planet gear and the second planet gear engaging the first geared portion of the sun gear on opposite sides of the sun gear, the first planet gear engaging a second internal spline of the ring gear housing, the second internal spline of the ring gear housing being radially farther from the motor shaft than the first geared portion of the sun gear, the second planet gear also engaging the second internal spline of the ring gear housing, the first planet gear rotating about the first planet gear axle and also revolving about the sun gear, the second planet gear rotating about the second planet gear axle and also revolving about the sun gear; and (H) a planet gear carrier symmetrically surrounding the motor shaft and comprising a first arm connecting the two planet gear axles and a second arm rigidly connected and perpendicular to the first arm of the planet gear carrier, the second arm having a first end and an opposite second end;

(v) a pair of fan blades arranged symmetrically about the motor shaft and denoted here as a first fan blade and a second fan blade, the first fan blade having a first fan blade tip and a first fan blade root, the second fan blade having a second fan blade tip and a second fan blade root;

(vi) a blade deployment mechanism comprising: (A) a main fan plate rigidly connected to the ring gear housing; (B) a pair of drive links denoted here as a first drive link and a second drive link, each of the first drive link and the second drive link having a first; curved end and an opposite second end, the first end of the first drive link being connected to the first end of the second arm of the planet gear carrier, the first end of the second drive link being connected to the second end of the second arm of the planet gear carrier; (C) a pair of idler arms denoted here as a first idler arm and a second idler arm, the first idler arm being connected to the first drive link, the second idler arm being connected to the second drive link, the first idler arm being between the first end and the second end of the first drive link, the first idler arm pivotally connecting the first drive link to the main fan plate, the second idler area being between the first end and the second end of the second drive link, the second idler arm pivotally connecting the second drive link to the main fan plate; (D) a pair of blade links denoted here as a first blade link and a second blade link, the first blade link being pivotally connected to the second end of the first drive link at an end of the first blade link, the second blade link being pivotally connected to the second end of the second drive link at an end of the second blade link; and (E) a pair of blade pivot assembly assemblies mounted to the main fan plate, denoted here as a first blade pivot assembly and a second blade pivot assembly, the first blade pivot assembly being connected to an opposite end of the first blade link, the second blade pivot assembly being connected to an opposite end of the second blade link, the first blade pivot assembly pivotally connecting the first fan blade to the main fan plate at the first fan blade root, the second blade pivot assembly pivotally connecting the second fan blade to the main fan plate at the second fan blade root;

(b) energizing the electromagnetic coil to produce a magnetic force;

(c) the magnetic force pulling the clutch plate in contact with the contact surface, thereby locking the ring gear housing to the motor shaft via the coil housing;

(d) the magnetic force also pulling the sun gear toward the electromagnetic coil and disengaging the sun gear from the first internal spline of the ring gear housing;

(e) operating the electric fan motor in a first rotative direction;

(f) the electric fan motor thereby turning the motor hub and the sun gear about the motor shaft in the first rotative direction, the sun gear engaging the first planet gear and the second planet gear causing the first planet gear and the second planet gear to revolve around the sun gear in a second rotative direction opposite to the first rotative direction, which causes the planet gear carrier to rotate about the motor shaft in the first rotative direction;

(g) the rotating planet gear carrier thereby activating the first drive link and the second drive link, the first end of the first drive link rotating about the motor shaft in the first rotative direction and activating the first blade link to rotate in the first rotative direction about the first blade pivot assembly, thereby pivoting the first fan blade about the first blade pivot assembly in the first rotative direction and into a deployed configuration where the first fan blade tip is farther from the motor shaft than the first fan blade root, the first end of the second drive link rotating about the motor shaft in the first rotative direction and activating the second blade link to rotate in the first rotative direction about the second blade pivot assembly, thereby pivoting the second fan blade about the second blade pivot assembly in the first rotative direction and into the deployed configuration where the second fan blade tip is farther from the motor shaft than the second fan blade root;

(h) de-energizing the electromagnetic coil;

(i) the plurality of clutch plate springs pushing the clutch plate toward the ring gear housing and out of contact with the contact surface, thereby unlocking the ring gear housing from the motor shaft and the coil housing;

(j) the sun gear spring pushing the sun gear away from the electromagnetic coil and toward the electric fan motor to engage the sun gear with the first internal spline of the ring gear housing;

(k) operating the electric fan motor to revolve the first fan blade and the second fan blade about the motor shaft for a desired period of time;

(l) stopping the electric fan motor;

(m) energizing the electromagnetic coil to produce the magnetic force;

(n) the magnetic force pulling the clutch plate in contact with the contact surface, thereby locking the ring gear housing to the motor shaft via the coil housing;

(o) the magnetic force pulling the sun gear toward the electromagnetic coil and disengaging the sun gear from the first internal spline of the ring gear housing;

(p) operating the electric fan motor in the second rotative direction;

(q) the electric fan motor thereby turning the sun gear about the motor shaft in the second rotative direction, the sun gear engaging the first planet gear and the second planet gear, causing the first planet gear and the second planet gear to revolve around the sun gear in the first rotative direction, which causes the planet gear carrier to rotate about the motor shaft in the second rotative direction;

(r) the rotating planet gear carrier thereby activating the first drive link and the second drive link, the first end of the first drive link rotating about the motor shaft in the second rotative direction and activating the first blade link to rotate in the second rotative direction about the first blade pivot assembly, thereby pivoting the first fan blade about the first blade pivot assembly in the second rotative direction and into a retracted configuration where the first fan blade tip is equidistant from the motor shaft as the first fan blade root, and the first end of the second drive link rotating about the motor shaft in the second rotative direction and activating the second blade link to rotate in the second rotative direction about the second blade pivot assembly, thereby pivoting the second fun blade about the second blade pivot assembly in the second rotative direction and into the retracted configuration where the second fan blade tip is equidistant from the motor shaft as the second fan blade root.

15. A method for deploying fan blades of a ceiling fan, the method comprising the steps of:

(a) providing a ceiling fan having:

(i) a stationary motor shaft;

(ii) an electric fan motor mounted to and rotating about the motor shaft;

(iii) a motor hub connected to the fan motor and rotating about the motor shaft with the fan motor, the motor hub having an engagement surface;

(iv) a transmission mechanism connected to the motor hub, the transmission mechanism comprising: (1) a sun gear, the sun gear having an engagement portion, a first geared portion, and a second geared portion, the engagement portion being shaped and dimensioned to engage the engagement surface of the motor hub, the first geared portion of the sun gear having a series of gear teeth arranged radially about the motor shaft, the second gear portion also having a series of gear teeth arranged radially about the motor shaft; (2) a ring gear housing, the ring gear housing having a first internal spline to engage the second geared portion of the sun gear; (3) a clutch plate connected to the ring gear housing by a clutch plate spring, the clutch plate spring providing spring resistance to the clutch plate moving away from the ring gear housing; (4) a contact surface fixed to the motor shaft and being adjacent to the clutch plate; (5) an electromagnetic coil; (6) a sun gear spring, the sun gear spring providing a spring force to engage the engagement portion of the sun gear with the engagement surface of the motor hub; (7) a first planet gear and a second planet gear, the first planet gear being rotatively connected to the ring gear housing about a first planet gear axle, the first planet gear engaging a second internal spline of the ring gear housing, the second internal spline of the ring gear housing being radially farther from the motor shaft than the first geared portion of the sun gear, the first planet gear rotating about the first planet gear axle and also revolving about the sun gear, the second planet gear rotatively connected to the ring gear housing about a second planet gear axle, the second planet gear also engaging the second internal spline of the ring gear housing, the second planet gear rotating about the second planet gear axle and also revolving about the sun gear; and (8) a planet gear carrier connecting the first planet gear axle and the second planet gear axle;

(v) a first fan blade, the first fan blade having a first fan blade tip and a first fan blade root;

(vi) a blade deployment mechanism comprising: (1) a main fan plate connected to the ring gear housing; (2) a first drive link, the first drive link having a first, curved end and an opposite second end, the first end of the first drive link being connected to the planet gear carrier; (3) a first blade link, the first blade link being pivotally connected to the second end of the first drive link at an end of the first blade link; and (4) a first blade pivot assembly mounted to the main fan plate, the first blade pivot assembly being connected to an opposite end of the first blade link; the first blade pivot assembly pivotally connecting the first fan blade to the main fan plate at the first fan blade root;

(b) energizing the electromagnetic coil to produce a magnetic force;

(c) the magnetic force pulling the clutch plate in contact with the contact surface, thereby locking the ring gear housing to the motor shaft;

(d) the magnetic force also pulling the sun gear toward the electromagnetic coil and disengaging the sun gear from the first internal spline of the ring gear housing;

(e) operating the electric fan motor in a first rotative direction;

(f) the electric fan motor thereby turning the motor hub and the sun gear about the motor shaft in the first rotative direction, the sun gear engaging the first planet gear and the second planet gear causing the first planet gear and the second planet gear to revolve around the sun gear in a second rotative direction opposite to the first rotative direction, which causes the planet gear carrier to rotate about the motor shaft in the first rotative direction;

(g) the rotating planet gear carrier thereby activating the first drive link, the first end of the first drive link rotating about the motor shaft in the first rotative direction and activating the first blade link to rotate in the first rotative direction about the first blade pivot assembly, thereby pivoting the first an blade about the first blade pivot assembly in the first rotative direction and into a deployed configuration where the first fan blade tip is farther from the motor shaft than the first fan blade root.

16. The method of claim 15, further comprising the steps of:

(a) de-energizing the electromagnetic coil;

(b) the clutch plate spring pushing the clutch plate toward the ring gear housing and out of contact with the contact surface, thereby unlocking the ring gear housing from the motor shaft;

(c) the sun gear spring pushing the sun gear away from the electromagnetic coil and toward the electric fan motor to engage the sun gear with the first internal spline of the ring gear housing; and (d) operating the electric fan motor to revolve the first fan blade about the motor shaft for a desired period of time.

17. The method of claim 16, further comprising the steps of retracting the fan blades by:

(a) stopping the electric fan motor;

(b) energizing the electromagnetic coil to produce the magnetic force;

(c) the magnetic force pulling the clutch plate in contact with the contact surface, thereby locking the ring gear housing to the motor shaft;

(d) the magnetic force pulling the sun gear toward the electromagnetic coil and disengaging the sun gear front the first internal spline of the ring gear housing;

(e) operating the electric fan motor in the second rotative direction;

(f) the electric fan motor thereby turning the sun gear about the motor shaft in the second rotative direction, the sun gear engaging the first planet gear and the second planet gear, causing the first planet gear and the second planet gear to revolve around the sun gear in the first rotative direction, which causes the planet gear carrier to rotate about the motor shaft in the second rotative direction; and (g) the rotating planet gear carrier thereby activating the first drive link, the first end of the first drive link rotating about the motor shaft in the second rotative direction and activating the first blade link to rotate in the second rotative direction about the first blade pivot assembly, thereby pivoting the first fan blade about the first blade pivot assembly in the second rotative direction and into a retracted configuration where the first fan blade tip is equidistant from the motor shaft as the first fan blade root.

18. A method for retracting fan blades of a ceiling fan, the method comprising the steps of:

(a) providing a ceiling fan having:

(i) a stationary motor shaft;

(ii) an electric fan motor mounted to and rotating about the motor shaft;

(iii) a motor hub connected to the fan motor and rotating about the motor shaft with the fan motor, the motor hub having an engagement surface;

(iv) a transmission mechanism connected to the motor hub, the transmission mechanism comprising: (1) a sun gear, the sun gear having an engagement portion, a first geared portion, and a second geared portion, the engagement portion being shaped and dimensioned to engage the engagement surface of the motor hub, the first geared portion of the sun gear having a series of gear teeth arranged radially about the motor shaft, the second gear portion also having a series of gear teeth arranged radially about the motor shaft; (2) a ring gear housing, the ring gear housing having a first internal spline to engage the second geared portion of the sun gear; (3) a clutch plate connected to the ring gear housing by a clutch plate spring, the clutch plate spring providing spring resistance to the clutch plate moving away from the ring gear housing; (4) a contact surface fixed to the motor shaft and being adjacent to the clutch plate; (5) an electromagnetic coil; (6) a sun gear spring, the sun gear spring providing a spring force to engage the engagement portion of the sun gear with the engagement surface of the motor hub; (7) a first planet gear and a second planet gear, the first planet gear being rotatively connected to the ring gear housing about a first planet gear axle, the first planet gear engaging a second internal spline of the ring gear housing, the second internal spline of the ring gear housing being radially farther from the motor shaft than the first geared portion of the sun gear; the first planet gear rotating about the first planet gear axle and also revolving about the sun gear, the second planet gear rotatively connected to the ring gear housing about a second planet gear axle, the second planet gear also engaging the second internal spline of the ring gear housing, the second planet gear rotating about the second planet gear axle and also revolving about the sun gear; and (8) a planet gear carrier connecting the first planet gear axle and the second planet gear axle;

(v) a first fan blade, the first fan blade having a first fan blade tip and a first fan blade root;

(vi) a blade deployment mechanism comprising: (1) a main fan plate connected to the ring gear housing; (2) a first drive link, the first drive link having a first, curved end and an opposite second end, the first end of the first drive link being connected to the planet gear carrier; (3) a first blade link, the first blade link being pivotally connected to the second end of the first drive link at an end of the first blade link; and (4) a first blade pivot assembly mounted to the main fan plate, the first blade pivot assembly being connected to an opposite end of the first blade link, the first blade pivot assembly pivotally connecting the first fan blade to the main fan plate at the first fan blade root;

(b) energizing the electromagnetic coil to produce the magnetic force;

(c) the magnetic force pulling the clutch plate in contact with the contact surface, thereby locking the ring gear housing to the motor shaft;

(d) the magnetic force pulling the sun gear toward the electromagnetic coil and disengaging the sun gear from the first internal spline of the ring gear housing;

(e) operating the electric fan motor in a second rotative direction;

(f) the electric fan motor thereby turning the sun gear about the motor shaft in the second rotative direction, the sun gear engaging the first planet gear and the second planet gear, causing the first planet gear and the second planet gear to revolve around the sun gear in the first rotative direction, which causes the planet gear carrier to rotate about the motor shaft in the second rotative direction; and (g) the rotating planet gear carrier thereby activating the first drive link, the first end of the first drive link rotating about the motor shaft in the second rotative direction and activating the first blade link to rotate in the second rotative direction about the first blade pivot assembly, thereby pivoting the first fan blade about the first blade pivot assembly in the second rotative direction and into a retracted configuration where the first fan blade tip is equidistant from the motor shaft as the first fan blade root.

19. The method of claim 18, the first fan blade sliding between the main fan plate and the clutch plate in the retracted configuration.

20. A rotating fan comprising:

(a) a stationary motor shaft;

(b) an electric fan motor mounted to and rotating about the motor shaft;

(c) a speed reduction drive;

(d) means for locking the speed reduction drive to the electric fan motor;

(e) means for unlocking the speed reduction drive from the electric fan motor;

(f) a selection mechanism operatively controlling the means for locking and the means for unlocking the speed reduction drive;

(g) a fan blade, the fan blade having a fan blade tip and a fan blade root; and (h) a blade deployment mechanism;

wherein in an de-energized state, the selection mechanism engages the means for locking the speed reduction drive to the electric fan motor, and the electric fan motor directly revolves the speed reduction drive and the fan blade about the motor shaft; and wherein in a energized state, the selection mechanism engages the means for unlocking the speed reduction drive from the electric fan motor, and the electric fan motor does not revolve the speed reduction drive or the fan blade about the motor shaft;

wherein in a deployed configuration, the speed reduction drive engages the blade deployment mechanism to position the fan blade such that the fan blade tip is farther from the motor shaft than the fan blade root is from the motor shaft; and wherein in a retracted configuration, the speed reduction drive engages the blade deployment mechanism to position the fan blade such that the fan blade tip is equidistant from the motor shaft as the fan blade root is from the motor shaft.

* * * * *